US008230792B2

(12) United States Patent
Khattab

(10) Patent No.: US 8,230,792 B2
(45) Date of Patent: Jul. 31, 2012

(54) WELL CAR WITH CROSS MEMBER

(75) Inventor: Mohamed A. Khattab, Burlington (CA)

(73) Assignee: National Steel Car Limited (CA)

( * ) Notice: Subject to any disclaimer, the term of this patent is extended or adjusted under 35 U.S.C. 154(b) by 22 days.

(21) Appl. No.: 12/979,403

(22) Filed: Dec. 28, 2010

(65) Prior Publication Data

US 2011/0185942 A1 Aug. 4, 2011

Related U.S. Application Data

(63) Continuation of application No. 12/397,044, filed on Mar. 3, 2009, now Pat. No. 7,866,267, which is a continuation of application No. 11/764,572, filed on Jun. 18, 2007, now Pat. No. 7,497,171, which is a continuation of application No. 10/990,299, filed on Nov. 16, 2004, now Pat. No. 7,334,528, which is a continuation of application No. 10/340,019, filed on Jan. 10, 2003, now Pat. No. 6,877,226, which is a continuation of application No. 09/863,812, filed on May 23, 2001, now Pat. No. 6,505,564.

(51) Int. Cl.
*B61D 17/00* (2006.01)

(52) U.S. Cl. ..... 105/419; 105/413; 105/355

(58) Field of Classification Search ..... 105/413, 105/414, 419, 396, 415, 355, 404; 410/77
See application file for complete search history.

(56) References Cited

U.S. PATENT DOCUMENTS 2,468,101 A 4/1949 Nampa
2,494,404 A 1/1950 Nixon
2,894,462 A 7/1959 Newcomer et al.
2,958,492 A 11/1960 Maynard
2,971,795 A 2/1961 Winski
2,977,900 A 4/1961 Farrar
(Continued)

FOREIGN PATENT DOCUMENTS

DE 3637127 8/1987
(Continued)

OTHER PUBLICATIONS

Car and Locomotive Cyclopedia, 1966 ed., Simmons-Boardman Publishing Corporation, New York, NY, pp. 151, 285 to 289.

(Continued)

*Primary Examiner* — Mark Le
(74) *Attorney, Agent, or Firm* — Hahn Loeser & Parks LLP; Michael H. Minna

(57) ABSTRACT

A well car for carrying shipping containers has a pair of end structures supported by rail car trucks, a pair of first and second spaced apart side beams extending between the end structures and a well defined therebetween. A container support cross member is mounted between the side sills in a position to support an end of a shipping container load carried within the well. The container support cross member may be a monolithic beam member with a attachment fitting formed at an end thereof. The attachment fitting is connectable to a side sill at a moment connection. The remaining end of the cross member is similarly configured and connected to the second side sill. Each end of the cross member has load bearing surface portions which may be used for supporting a corner of a shipping container. The moment connections permit a bending moment to be carried by the cross member between the first and second side sills.

20 Claims, 17 Drawing Sheets

U.S. PATENT DOCUMENTS

| | | | |
|---|---|---|---|
| 2,991,734 | A | 7/1961 | Gabriel |
| 3,009,426 | A | 11/1961 | Nampa |
| 3,061,255 | A | 10/1962 | Gallo et al. |
| 3,186,357 | A | 6/1965 | Fillion |
| 3,223,259 | A | 12/1965 | Nicholson |
| 3,291,072 | A | 12/1966 | Cunningham |
| 3,291,073 | A | 12/1966 | James |
| 3,307,495 | A | 3/1967 | Chapman et al. |
| 3,307,497 | A | 3/1967 | Chapman et al. |
| 3,353,506 | A | 11/1967 | Snyder et al. |
| 3,376,062 | A | 4/1968 | Chosy et al. |
| 3,392,682 | A | 7/1968 | Francis |
| 3,413,931 | A | 12/1968 | Augustine |
| 3,430,981 | A | 3/1969 | Tarantola |
| 3,465,692 | A | 9/1969 | Hyatt |
| 3,493,210 | A | 2/1970 | Brenner |
| 3,508,503 | A | 4/1970 | Daly |
| 3,581,674 | A | 6/1971 | O'Leary |
| 3,605,638 | A | 9/1971 | James |
| 3,628,466 | A | 12/1971 | Lyons et al. |
| 3,658,011 | A | 4/1972 | West et al. |
| 3,658,195 | A | 4/1972 | Fantin |
| 3,875,617 | A | 4/1975 | Cline |
| 3,912,325 | A | 10/1975 | Sudyk |
| 3,922,004 | A | 11/1975 | Chamberlain |
| 4,102,274 | A | 7/1978 | Feary et al. |
| 4,204,479 | A | 5/1980 | Rosa |
| 4,240,773 | A | 12/1980 | Terry |
| 4,315,707 | A | 2/1982 | Fernbach |
| 4,357,048 | A | 11/1982 | Zehnder et al. |
| 4,367,059 | A | 1/1983 | Stubbins |
| 4,451,188 | A | 5/1984 | Smith et al. |
| 4,526,500 | A | 7/1985 | Patrick |
| 4,580,843 | A | 4/1986 | Lund |
| 4,686,907 | A | 8/1987 | Woollam et al. |
| 4,702,653 | A | 10/1987 | Gaulding et al. |
| 4,732,528 | A | 3/1988 | Good |
| 4,754,709 | A | 7/1988 | Gramse et al. |
| 4,782,762 | A | 11/1988 | Johnstone et al. |
| 4,805,539 | A | 2/1989 | Ferris et al. |
| 4,841,876 | A | 6/1989 | Gramse et al. |
| 5,048,885 | A | 9/1991 | Bomar |
| 5,054,403 | A | 10/1991 | Hill et al. |
| 5,085,152 | A | 2/1992 | Tylisz et al. |
| 5,170,717 | A | 12/1992 | Richmond et al. |
| 5,191,842 | A | 3/1993 | Tinkler |
| 5,211,518 | A | 5/1993 | Mimica |
| 5,228,823 | A | 7/1993 | Crook |
| 5,329,858 | A | 7/1994 | Morris et al. |
| 5,336,027 | A | 8/1994 | Paddock |
| 5,341,747 | A | 8/1994 | Fetterman et al. |
| 5,343,812 | A | 9/1994 | Ishida |
| 5,343,813 | A | 9/1994 | Septer |
| 5,373,792 | A | 12/1994 | Pileggi et al. |
| 5,401,129 | A | 3/1995 | Eatinger |
| 5,425,608 | A | 6/1995 | Reitnouer |
| 5,476,348 | A | 12/1995 | Shelleby |
| 5,520,489 | A | 5/1996 | Butcher et al. |
| 5,538,376 | A | 7/1996 | Borda |
| 5,562,046 | A | 10/1996 | Fetterman et al. |
| 5,564,341 | A | 10/1996 | Martin |
| 5,622,116 | A | 4/1997 | Carlton |
| 5,765,485 | A | 6/1998 | Thoman et al. |
| 5,954,465 | A | 9/1999 | Ellerbush |
| 6,003,445 | A | 12/1999 | Coslovi et al. |
| 6,077,005 | A | 6/2000 | Westlake |
| 6,190,100 | B1 | 2/2001 | Mawji |
| 6,196,137 | B1 * | 3/2001 | Forbes ..... 105/413 |
| 6,354,778 | B1 * | 3/2002 | Coslovi et al. ..... 410/94 |
| 6,505,564 | B2 * | 1/2003 | Khattab ..... 105/413 |
| 6,579,048 | B2 | 6/2003 | Al-Kaabi et al. |
| 6,584,912 | B2 * | 7/2003 | Forbes ..... 105/419 |
| 6,643,931 | B2 | 11/2003 | Nees |
| 6,704,991 | B1 * | 3/2004 | Coulborn et al. ..... 29/525.14 |
| 6,866,452 | B2 * | 3/2005 | Khattab et al. ..... 410/94 |
| 6,877,226 | B2 * | 4/2005 | Khattab ..... 29/897.2 |
| 6,923,607 | B2 | 8/2005 | Al-Kaabi et al. |
| 7,497,171 | B2 | 3/2009 | Khattab |
| 2003/0029353 | A1 | 2/2003 | Coulborn et al. |

FOREIGN PATENT DOCUMENTS

| | | |
|---|---|---|
| GB | 2052416 | 1/1981 |

OTHER PUBLICATIONS

Car and Locomotive Cyclopedia, 1974 ed., Simmons-Boardman Publishing Corporation, New York, NY, pp. S3-59 to S3-65.

Car and Locomotive Cyclopedia, 1980 ed., Simmons-Boardman Publishing Corporation, New York, NY, pp. 148-152 and 154.

Car and Locomotive Cyclopedia, 1997 ed., Simmons-Boardman Publishing Corporation, New York, NY, pp. 79 to 81 and 90.

Promotional material Zeftek Inc., Montgomery, Illinois, date unknown.

Promotional material Thrall Car, Chicago Heights, Illinois, date unknown.

Promotional material and photographs, Norfolk, Southern, showing a coil car bearing model No. NS 167210, date unknown.

Photographs of various coil cars, taken on Jan. 15, 1997.

Photograph of coil car, taken on Nov. 6, 1995.

Photograph of coil car, taken on Feb. 6, 1996.

Car and Locomotive Cyclopedia, 1984 ed., Simmons-Boardman Publishing Corporation, New York, NY, pp. 95 and 137.

* cited by examiner

WELL CAR WITH CROSS MEMBER

This application is a continuation of U.S. patent application Ser. No. 12/397,044, filed Mar. 3, 2009, now U.S. Pat. No. 7,866,267, which is a continuation of U.S. patent application Ser. No. 11/764,572, filed Jun. 18, 2007, now U.S. Pat. No. 7,497,171, which is a continuation of U.S. patent application Ser. No. 10/990,299 filed Nov. 16, 2004, now U.S. Pat. No. 7,334,528, which is a continuation of U.S. patent application Ser. No. 10/340,019 filed Jan. 10, 2003, now U.S. Pat. No. 6,877,226, which is a continuation of U.S. patent application Ser. No. 09/863,812 filed May 23, 2001, now U.S. Pat. No. 6,505,564, the disclosures of which are hereby incorporated by reference.

FIELD OF THE INVENTION

This invention relates to rail road freight cars, and more particularly to a rail road well car having cross members for supporting lading carried in the well car.

BACKGROUND OF THE INVENTION

Railway well cars may be conceptualized as having a pair of deep, spaced apart, parallel beams, with floor members extending cross-wise between the beams to form a support frame for lading. The ends of the deep beams are mounted to end structures, and the end structures are supported on a pair of railcar trucks. Although single unit well cars are still common, there has been a trend in recent years toward articulated, multi-unit railcars that permit a relatively larger load to be carried on fewer railcar trucks. The cross section of the car is generally defined by the pair of spaced apart left and right hand deep side beams, and structure between the side sills of the side beams to support such lading as may be placed in the well. Typically the floor, or lading support structure in the well includes diagonally oriented members to carry shear between the side sills under lateral loading conditions.

Contemporary well cars may carry a number of alternative loads made up of containers in International Standards Association (ISO) sizes or domestic sizes, and of highway trailers. The ISO containers are 8'-0" wide, 8'-6" high, and come in a 20'-0" length weighing up to 52,900 lbs., or a 40'-0" length weighing up to 67,200 lbs. Domestic containers are 8'-6" wide and 9'-6" high. Their standard lengths are 45', 48' and 53'. All domestic containers have a maximum weight of 67,200 lbs. Recently 28' long domestic containers have been introduced in North America. They are generally used for courier services which have lower lading densities. The 28' containers have a maximum weight of 35,000 lbs.

Common sizes of highway trailers are the 28' pup trailer weighing up to 40,000 lbs., and the 45' to 53' trailer weighing up to 60,000 lbs. for a two axle trailer and up to 90,000 lbs., for a three axle trailer. Hitches are located on the end structures at both ends of the well. The wheels of a trailer can rest in the well, with the front, or nose of the trailer overhanging the car end structure at one end or the other of the well. Where pup trailers are used, two back-to-back 28' pup trailers can be loaded in the well facing in opposite directions. Alternatively, shipping containers, typically of 20 ft., 28 ft, or 40 ft lengths may be placed in the well, with other shipping containers stacked on top in a "double-stack" configuration. Further, well cars can carry mixed loads of containers and trailers.

Whichever the case may be, a well car is required to withstand three kinds of loads. First, it must withstand longitudinal draft and buff loads inherent in pulling or pushing a train, particularly those loads that occur during slack run-ins and run-outs on downgrades and upgrades. Other variations of the longitudinal load are the 1,000,000 lbs., squeeze load and the 1,250,000 lbs., single ended impact load. Second, the well car must support a vertical load due to the trailers or shipping containers it carries. Third, it must be able to withstand lateral loading as the well car travels along curves and switch turn-offs.

For example, in an earlier well car, as shown in U.S. Pat. No. 4,893,567 of Hill et al., issued Jan. 16, 1990, the structure between the side sills includes lateral cross members. The ends of the cross members are mounted to longitudinally extending side sills. The cross members are indirectly attached to the side sills via hinged fittings which, in turn, are attached to the side sills. The hinge connection may tend to permit some flexing of the structure under some loads, while still providing a connection conceptually analogous to a pin joint for resistance to lateral deflection.

Longitudinal compressive loads imposed on the well car are transmitted into the car at the draft gear stops in the coupler pocket; carried outboard in the end structures through the end shear plate, sills and bolsters to the side beams; and then along the top and bottom chords to the other end of the car. The combined compressive longitudinal loads alone, or in combination with the effect of the vertical container loads tend to urge the top chords to buckle. Typically under compressive loading the top chords of the side beams tend to move laterally inboard relative to the bottom chords.

One way to address this tendency is to employ top chords of heavier section and high polar moment of inertia. This may tend to increase the weight of the side beams. It is generally desirable to avoid increasing the weight of rail road cars, since an increase in weight implies an increase in cost of material for fabrication, increased running costs when the car is empty, and a reduced maximum lading capacity since the loaded weight of the car plus lading must not exceed a given limit, whether 263,000 lbs., 286,000 lbs., or 315,000 lbs., as may govern the service for which the car is intended. For these reasons, it is generally preferable to use a lesser weight of metal more efficiently.

The inward deflection of the top chords of the side beams under buckling loads (as suggested by the intermittently dashed lines exaggeratedly representing deflection, the top chord deflection being signified by 'δ' in FIG. 4*a*), can be resisted to some extent by providing an opposing spring mechanism. To that end, it is desirable to employ a continuous cross member from side to side, and side posts connecting the top and bottom chords. The attachment to the side sills is conceptually similar to that of a built-in end condition. That is, a built-in end condition occurs where the connection joint will not only carry a shear load, but will, in addition, transmit a bending moment. If the cross member transmits moments at connections to both side sills, and assuming that the cross member is of significant section relative to the side sills, then twisting of the side beams will tend to impose a bending load in the cross member. As the car is symmetrical, this moment may tend to be resisted by an equal and opposite moment arising in the other half of the car, as suggested by moment 'M', in FIG. 4*a*. When this occurs the cross member, and the other members in the load path, such as the side posts, co-operate to act as a spring assembly tending to resist the top chord deflection (buckling), and side beam twisting.

The floor structure of a container carrying well car may typically include lading bearing cross members (a) at the ends of the well in the 40 foot container pedestal positions, and (b) in the middle of the well in the form of a central cross member to support containers at the 20 foot position. These vertical load bearing cross members support the shipping container corners. The floor structure may also include several intermediate cross members, and diagonals. The intermediate cross members and diagonal members are conceptually like the members of a pin-jointed truss and are provided to aid in resistance to lateral loads, as opposed to bearing the vertical load of the containers. Consequently, inasmuch as these additional cross members perform a different function, they tend to be of significantly reduced section relative to the container bearing cross members.

In at least one earlier car, the connection of the floor cross members and diagonal members to the side sills has been the source of fatigue cracking concerns. When the cross members are welded in place, it is not uncommon for portions of the weld to be placed in repeated, cyclic loading during operation. Inasmuch as it is sometimes difficult to obtain consistent, defect-free welds, defects in the welds can provide fatigue crack initiation sites.

Use of hinges may tend to reduce the probability of fatigue crack initiation due to cyclic flexing in bending, since hinges do not transmit a bending moment. However, a hinged cross member may also not tend to function to resist the lateral flexing of the side sills particularly well. A bolted connection may be preferable to a welded connection, since it avoids the possibility of weld defects and high level of stress concentration due to geometric nonlinearities.

Other cross member assemblies, for example, as shown in U.S. Pat. No. 5,465,670 of Butcher, issued Nov. 14, 1995, similarly have connections to the side sills in the horizontal plane only. U.S. Pat. No. 5,465,670 shows a three part main cross member assembly having a linear section matingly engaged with a mounting bracket at either end. The mounting bracket is welded to the linear section and then attached to a horizontal leg of a side sill. Both the main cross members and corresponding single piece intermediate cross members have hollow rectangular cross-sections. No additional reinforcement is provided at the ends of either cross member where shear forces caused by lading are greatest.

The use of a three-part cross member at either the central, 20 foot container position at mid-span in the well between the rail car trucks, or at the 40 foot container pedestal positions as shown by Butcher, may also have disadvantages. Container support castings were connected to either end of an intermediate cross member at a pair of peripheral welds respectively. These welded joints were labor intensive and required full ultrasonic (UT) inspection. In service, the welds are subjected to relatively severe cyclic loading. Flaws in such welded joints may tend to become fatigue crack initiation sites when subjected to cyclic loading. It would be advantageous to employ a cross member at a container support position, whether at the 20 or 40 foot location, that tends not to expose a welded joint to cyclic loading. It would be most preferable to employ a forged (that is, hot or cold formed), one-piece monolithic beam that under-hangs the well from side sill to side sill.

SUMMARY OF THE INVENTION

In an aspect of the invention there is a container support cross member for supporting a shipping container in a well of a rail road well car. The well car has a pair of first and second spaced apart end structures and a pair of first and second spaced apart side beams mounted to extend between the end structures. The side beams and end structures co-operate to define the well therebetween. The container support cross member has a first member having a first end, a second end, and a medial portion between the first and second ends. The first member is monolithic. A first toe is formed at the first end of the first member. The first toe has a first upwardly extending flange. The first upwardly extending flange of the monolithic first member has bores defined therein to permit the first bent toe to be attached by a mechanical fastener to the first side beam. A second toe is formed at the second end of the first member. The second toe has a second upwardly extending flange. The second upwardly extending flange has bores defined therein to permit the second toe to be attached by a mechanical fastener to the second side beam. The container support cross member has load bearing interfaces upon which to seat respective corners of one end of a shipping container, by which interfaces loads are passed into the first member.

In an additional feature of that aspect of the invention, the first flange has a root and a tip. The first flange has a width. The width is narrower at the tip than at the root. In another additional feature, the first flange has a root and a tip, and the flange has a through thickness. The through thickness is greater at the root than at the tip. In yet another additional feature, the first toe has a horizontal portion adjoining the medial portion of the cross member. The first flange extends upwardly from the horizontal portion. The bores in the flange include at least a first bore offset upwardly from the horizontal portion by a first distance, and at least a second bore offset upwardly from the horizontal portion by a second distance. The second distance is greater than the first distance. In still another additional feature, the bores in the flange run predominantly horizontally. The first toe has at least one lug formed thereat. The lug has a bore formed therein; and the bore of the lug extends predominantly vertically.

In still yet another additional feature, the monolithic member is formed from an initially flat monolithic bar. The first and second toes are formed from ends of the bar bent upwardly to form the flanges. The flanges are cut to have a profile having a root, and a tip. The profile has a width narrowing from the root to the tip. The flanges are machined to have a thickness that is greater at the root than at the tip. In another additional feature, the monolithic first member is formed from an initially flat bar. Each of the flanges of the toes are formed by bending an end of the flat bar such that the monolithic member has a U-shape when viewed from one side. In a further additional feature, the first toe has a horizontal portion between the medial portion of the first-member and the flange of the first toe. The horizontal portion is narrower adjacent to the flange than adjacent to the medial portion.

In yet a further additional feature, a second member is mounted to the medial portion of the first member. The first and second members co-operate to form a hollow section. In still a further additional feature, at least a second member is mounted to the medial portion of the first member to form a laminate. In another additional feature, the cross member has a longitudinal axis running from toe to toe, and the medial portion has a vertical slot formed therein. The slot has a major axis extending in the direction of the longitudinal axis. In still another additional feature, the medial portion is of generally uniform thickness. The slot passes fully through the medial portion, and the slot is located in the medial portion along the longitudinal axis thereof. In yet another additional feature, the medial portion has two of the slots formed therein. The slots lie end to end relative to each other and are separated by a web. In a further additional feature, a container support cone is mounted to each of the load bearing interfaces. In still a further additional feature, at least one diagonal strut root fitting is mounted to the medial portion of the cross member.

In another additional feature, the cross member has a second member mounted to the first member. The first and second members co-operate to define a hollow section beam having an upper flange, a lower flange and a pair of spaced apart webs extending between the upper and lower flanges. The strut root fitting is mounted to one of the webs. The cross member has a plate mounted between the webs within the hollow section to provide web continuity with the strut root fitting.

In another aspect of the invention, there is a container support cross member for supporting a shipping container in a well of a rail road well car. The well car has a pair of first and second spaced apart end structures and a pair of first and second spaced apart side beams mounted to extend between the end structures. The side beams and end structures co-operate to define the well therebetween. The container support cross member has a first member having a first end portion, a second end portion, and a medial portion between the first and second end portions. The first member is monolithic. A first toe is formed at the first end of the first member. The first toe has a first upwardly extending flange. The first upwardly extending flange of the monolithic first member has bores defined therein to permit the first bent toe to be attached by a mechanical fastener to the first side beam. A second toe is formed at the second end of the first member. The second toe has a second upwardly extending flange. The second upwardly extending flange has bores defined therein to permit the second toe to be attached by a mechanical fastener to the second side beam. A second member is mounted to at least the medial portion of the monolithic first member. The second member co-operates with the medial portion to form a hollow section beam. The container support cross member has spaced apart load bearing interfaces upon which to seat respective corners of one end of a shipping container, by which interfaces loads are passed into the first member.

In an additional feature of that aspect of the invention, the medial portion of the first monolithic member is stepped downwardly relative to the toes. In another additional feature, the first and second members, when mounted together, define a box section. In yet another additional feature, the second member has a flange and a pair of downwardly extending legs. The legs are connected to the medial portion of the first member. In still another additional feature, the second member has ends connected to the first and second flanges of the first beam member. In still yet another additional feature, the medial portion of the first beam member has a downward offset between the first end portion and the medial portion of the first beam member. The second beam member includes a pair of downwardly extending webs mounted to the first beam member. The downwardly extending webs of the second beam member conform to the offset.

In a further additional feature, the second beam member has load bearing regions defining the load bearing interfaces for bearing the corners of a shipping container. The load bearing regions are located adjacent to the first and second ends respectively of the first beam member. A reinforcement member is mounted between the first beam member and the load bearing region of the second beam member. In yet another additional feature, an aperture is formed in the load bearing region of the second beam member to permit the reinforcement to be welded to the second beam member. In still yet another additional feature, a container locating cone is mounted to at least one of the container support interfaces In a further aspect of the invention there is a container support cross member for supporting a shipping container in a well of a rail road well car. The well car has a pair of first and second spaced apart end structures and a pair of first and second spaced apart side beams mounted to extend between the end structures. The side beams and end structures co-operate to define the well therebetween. The container support cross member has a first beam member having a first end, a second end, and a medial portion between the first and second ends. The first beam member is monolithic. A first attachment fitting is formed at the first end for connecting the first end to the first side beam. A second attachment fitting is formed at the second end for connecting the second end to the second side beam. A second beam member is mounted to the first beam member. The first and second beam members co-operate to form a beam of hollow section. The second beam member has a first load bearing region for bearing the load of a corner of a shipping container. The load bearing region is located adjacent to the first end of the first member. At least one reinforcement member is mounted between the first beam member and load bearing region of the second beam member.

In an additional feature of that aspect of the invention, the reinforcement includes a flat bar standing on edge welded between the first and second beam members and forming a web therebetween. In another additional feature, the second beam member has at least one aperture formed therein to provide access for welding the reinforcement to the second beam member. In yet another additional feature, the reinforcement is welded to the second beam member by a plug weld. The aperture is at least partially filled in with weld-metal.

In still another additional feature, the attachment fittings include upturned flanges formed at each end of the first beam member. The second beam member is a downwardly opening channel section having first and second ends abutting and connected to the flanges of the first and second ends of the first beam member. In a further additional feature, container locating cones are mounted to the load bearing regions of the second beam member.

In still another aspect of the invention, there is a rail road well car for carrying shipping containers. The well car has a pair of first and second end structures supported by rail car trucks for rolling motion in a longitudinal direction. A pair of first and second spaced apart side beams extend between the end structures and have a well defined therebetween and structure for supporting a shipping container in the well. The structure for supporting a shipping container in the well includes at least a first container support cross member mounted between the side beams in a position to support one end of a shipping container carried within the well. The container support cross member has a monolithic beam member having a first end portion, a second end portion, and a medial portion between the first and second end portions. The first end of the monolithic beam member is connected by mechanical fasteners to the first side beam at a first moment connection. The second end of the monolithic beam member is connected by mechanical fasteners to the second side beam at a second moment connection. The container support cross member has first and second spaced apart load bearing regions for supporting respective corners of an end of shipping container.

In an additional feature of that aspect of the invention, the first and second side beams each have a top chord. A bottom chord and an intermediate member extends between the top chord and the bottom chord. The first and second ends of the container support cross member each have a respective upwardly extending flange formed thereat. Each flange seating is adjacent one of the bottom chords. The flanges are mechanically fastened to the bottom chords. In another additional feature, the bottom chords each have a first, upwardly extending leg and a second leg extending inwardly toward the well. Each end of the beam member has a horizontal portion seated above the second leg of one of the bottom chords. Each of the flanges of the beam member seats adjacent to the first leg of one of the bottom chords.

In yet another additional feature, the horizontal portions of the ends of the beam member are joined by mechanical fasteners to the second legs of the bottom chords, respectively, and the flanges are joined by mechanical fasteners to the first legs of the bottom chords. In still another additional feature, the flanges are joined by mechanical fasteners to the intermediate member of the side beam. In a further additional feature, the side beams have web doublers mounted to the intermediate members of the side beams abreast of the container support cross member. In still a further additional feature, the mechanical fasteners extend through the doublers. In another additional feature, the side beams have web stiffener posts mounted between the respective top chords and bottom chords abreast of the container support cross member. In yet another additional feature, the side beams have web doublers mounted to the intermediate members of the side beams abreast of the container support cross beam, and stiffener posts mounted between the respective bottom and top chords of the side beams abreast of the container support cross members.

In a further additional feature, the first and second side beams each have a top chord, a bottom chord and an intermediate web extending between the top chord and the bottom chord. The bottom chords each have a first, upwardly extending leg and a second leg extending inwardly toward the well. Each end of the monolithic beam member has a horizontal portion seated above the second leg of one of the bottom chords. The first and second ends of the container support cross member each have a respective upwardly extending flange formed thereat. Each flange seating is adjacent to the first leg of one of the bottom chords. The horizontal portion of the monolithic beam member is mechanically fastened to the second leg of the bottom chord. The flange is mechanically fastened to the first leg of the bottom chord at a first location. The flange is mechanically fastened to the side beam at a second location upwardly of the first leg of the bottom chord.

In another additional feature, the first side beam further has a first upwardly extending stiffener mounted abreast of the first cross member and the first moment connection. The second side beam further has a second upwardly extending stiffener mounted abreast of the first cross member and the second moment connection. In yet another additional feature, an intermediate cross member is mounted between the first and second side beams. The first side beam has a third upwardly extending stiffener mounted abreast of the intermediate cross member. The second side beam has a fourth upwardly extending stiffener mounted abreast of the intermediate cross member.

In still another additional feature, the first side beam further has a first top chord, a first bottom chord, and a first shear transfer member therebetween. The second side beam has a second top chord, a second bottom chord, and a second shear transfer member therebetween. The first and second upwardly extending stiffeners have a greater resistance to lateral flexure of the first and second top chords than the third and fourth upwardly extending stiffeners. In another additional feature, the first upwardly extending stiffener has a greater weight of section than the third upwardly extending stiffener. In still another additional feature, the first upwardly extending stiffener has a cross-section at mid height between the first top chord and the first bottom chord that has a higher second moment of area for resisting lateral flexure of the first top chord than the third upwardly extending stiffener. In a further additional feature, the first cross member is rigidly connected to the first stiffener and the second stiffener, whereby the first and second stiffeners and the first cross member co-operate to resist deflection of the first and second top chords in a direction transverse to the longitudinal direction.

In yet another additional feature, the first side beam further has a first upwardly extending stiffener mounted abreast of the first cross member and abreast of the first moment connection. The second side beam further has a second upwardly extending stiffener mounted abreast of the first cross member and abreast of the second moment connection. In still another additional feature, a second container support cross member is spaced from the first container support member. The first and second container support members are located to support opposite ends of a shipping container carried in the well. The second container support cross member is mounted between the first and second side beams. The first side beam has a third upwardly extending stiffener mounted abreast of the second container support cross member. The second side beam has a fourth upwardly extending stiffener mounted abreast of the second container support cross member.

In still yet another additional feature, the first side beam has a first top chord, a first bottom chord, and a first shear transfer member therebetween. The second side beam has a second top chord, a second bottom chord, and a second shear transfer member therebetween. The first and second upwardly extending stiffeners have a greater resistance to lateral flexure of the first and second top chords than the third and fourth upwardly extending stiffeners. In another additional feature, the first upwardly extending stiffener has a cross-section at mid height between the first top chord and the first bottom chord that has a higher second moment of area for resisting lateral flexure of the first top chord than the third upwardly extending stiffener.

In still another additional feature, the second container support cross member has a second monolithic beam member having a first end, a second end, and a medial portion between the first and second ends. The first end of the second monolithic beam member is connected to the first side beam at a third moment connection. The second end of the monolithic beam member is connected to the second side beam at a fourth moment connection. The second container support cross member has first and second spaced apart load bearing regions for supporting respective corners of another end of the shipping container. In yet another additional feature, the first cross member is located at substantially a mid-span location between the end structures. In a further additional feature, an end container support cross member is mounted between the first and second side beams. The end container cross member has first and second ends joined at moment connections to the first and second side beams respectively.

In another additional feature, the well car has two end container cross members. Each end container cross member is spaced about 20 feet from the first container support cross member to permit opposite ends of a 20 ft shipping container to be carried by the first container support cross member and by one of the end cross members. The end cross members also are alternately co-operable to support opposite ends of a 40 ft shipping container placed thereon. In still another additional feature, the end container cross member further has a pedestal at an end thereof for supporting a container. In yet another additional feature, the first and second bottom chords extend parallel to each other and have inwardly extending legs, and a gap being defined therebetween. The gap is less wide than an 8'-0" wide intermodal cargo container.

In another aspect of the invention, there is a well car for carrying shipping containers. The well car has a pair of first and second end structures supported by rail car trucks for rolling motion in a longitudinal direction, and a pair of first and second spaced apart side beams extending between the end structures and having a well defined therebetween. A container support cross member is mounted between the side beams to support a shipping container load carried within the well. The container support cross member has a first beam member having a first end, a second end, and a medial portion between the first and second ends. A first bent toe is formed at the first end of the first member. The first bent toe is connected to the first side beam at a first moment connection. A second bent toe is formed at the second end of the monolithic beam member. The second bent toe is connected to the second side beam at a second moment connection. A second beam member is mounted to the first beam member to form a hollow beam. A portion of the first beam member forms a first flange portion of the hollow beam. A portion of the second beam member forms a second flange portion of the compound beam. The second flange portion is spaced from the first flange portion. The first and second flange portions co-operate to resist vertical flexure. The hollow beam has a first load bearing region for supporting a corner of a shipping container, and a second load bearing region for supporting a second corner of a shipping container. The hollow beam has reinforcement between the first and second flange portions at the first and second load bearing regions.

In another aspect of the invention, there is a rail road well car for carrying shipping containers. The well car has a pair of first and second end structures supported by rail car trucks for rolling motion in a longitudinal direction, and a pair of first and second spaced apart side beams extending between the end structures and having a well defined therebetween. First and second container support cross members are mounted between the side beams in a position to support opposite ends of a shipping container load carried within the well. The first container support cross member has a monolithic beam member having a first end, a second end, and a medial portion between the first and second ends. The first end of the monolithic beam member is connected to the first side beam at a first moment connection. The second end of the monolithic beam member is connected to the second side beam at a second moment connection. The first container support cross member has respective first and second load bearing regions spaced to support respective corners of an end of a shipping container. Each side beam has a top chord, a bottom chord and a web extending between the top chord and the bottom chord. Each side beam has a stiffener extending between the top chord and the bottom chord abreast of the first container support cross member.

In an additional feature of that aspect of the invention, the well car has at least one intermediate cross tie extending between the first and second side beam members at a location between the first and second container support cross members. In an additional feature of that aspect of the invention, the stiffeners abreast of the first container support cross member are first stiffeners and each of the side beams has at least one second stiffener mounted to the web and extending between the top and bottom chords at a location distant from the first container support cross member. The first stiffeners are of greater resistance to sideways deflection of the top chord than the second stiffeners.

In another aspect of the invention, there is a rail road well car for carrying intermodal containers, comprising first and second end structures supported by rail car trucks for rolling motion in a longitudinal direction. A pair of first and second spaced apart side beams extend between the end structures. The side beams define a well therebetween in which to carry intermodal containers. A first cross member is mounted between the side beams in a position to bear corner loads from at least one container. The first cross member is located to support lading carried within the well. The first cross member has a first beam member having a first end, a second end, and a medial portion between the first and second ends. The first beam member has a first bent toe formed at the first end thereof. The first beam member has a second bent toe formed at the second end thereof. The first bent toe has a bolted moment connection to the first side beam. The second bent toe has a bolted moment connection to the second side beam. The first beam member is formed from a monolithic bar.

In another aspect of the invention, there is a rail road well car for carrying intermodal containers, comprising first and second end structures supported by rail car trucks for rolling motion in a longitudinal direction. A pair of first and second spaced apart side beams extend between the end structures. The side beams define a well therebetween in which to carry intermodal containers. The well has a length sufficient to accommodate two 20 foot shipping containers. A first cross member is mounted between the side beams in a position to bear loads from two adjacent 20 foot shipping containers carried in the well. The first cross member has a first beam member having a first end, a second end, and a medial portion between the first and second ends. The first beam member is formed from a monolithic bar. The first beam member has a first bent toe formed at the first end thereof. The first beam member has a second bent toe formed at the second end thereof. The first bent toe has a mechanically fastened moment connection to the first side beam. The second bent toe has a mechanically fastened moment connection to the second side beam. The first cross member has load bearing portions for accommodating corner fittings of ends of the two adjacent 20 foot shipping containers at the same time.

In another aspect of the invention, there is a rail road well car for carrying intermodal containers, comprising first and second end structures supported by rail car trucks for rolling motion in a longitudinal direction. A pair of first and second spaced apart side beams extend between the end structures. The side beams define a well therebetween in which to carry intermodal containers. A first cross member is mounted between the side beams in a position to support one end of a shipping container carried in the well. A second cross member is mounted between the side beams in a position to support another end of the shipping container. The first cross member has a first beam member having a first end, a second end, and a medial portion between the first and second ends. The first beam member has a first bent toe formed at the first end thereof. The first beam member has a second bent toe formed at the second end thereof. The first bent toe has a mechanically fastened moment connection to the first side beam. The second bent toe has a mechanically fastened moment connection to the second side beam. The first beam member is formed from a monolithic bar. The first cross member has a container locating cone mounted thereon by which to locate the container relative to the first cross member.

In another aspect of the invention, there is a rail road well car for carrying intermodal containers, comprising first and second end structures supported by rail car trucks for rolling motion in a longitudinal direction. A pair of first and second spaced apart side beams extend between the end structures. The side beams define a well therebetween in which to carry intermodal containers. A first cross member is mounted between the side beams in a position to support one end of a shipping container carried in the well. A second cross member is mounted between the side beams in a position to support another end of the shipping container. The first side beam has a first top chord, a first bottom chord, and a first shear transfer member extending between the first top and first bottom chords. The second side beam has a second top chord, a second bottom chord, and a second shear transfer member extending between the second top and second bottom chords. The first side beam has a first upwardly extending stiffener mounted abreast of the first cross member between the first top chord and the first bottom chord. The second side beam has a second upwardly extending stiffener mounted abreast of the first cross member between the second top chord and the second bottom chord. The first cross member has a first beam member having a first end, a second end, and a medial portion between the first and second ends. The first beam member has a first bent toe formed at the first end thereof. The first beam member has a second bent toe formed at the second end thereof. The first bent toe has a mechanically fastened moment connection to the first side beam adjacent to the first upwardly extending stiffener. The second bent toe has a mechanically fastened moment connection to the second side beam adjacent to the second upwardly extending stiffener. The first beam member is formed from a monolithic bar, whereby the first upwardly extending stiffener, the second upwardly extending stiffener and the first cross member co-operate to resist deflection of the first and second top chords in a lateral direction transverse to the longitudinal direction.

In another aspect of the invention, there is an intermodal well car having a pair of spaced-apart, longitudinally extending side beams. The side beams have a well defined therebetween for accommodating intermodal shipping containers. A plurality of container support cross members extend between the side beams. The shipping containers may be carried upon the container support cross members. One of said container support cross members has a first end and a second end, said first end having attachment fittings for connection to the first side beam of the well car, said second end having attachment fittings for connection to the second side beam of the well car, said cross member having a hollow section at said first and second ends thereof, and said hollow section ends having reinforcement webs mounted therewithin to stiffen said hollow sections at said first and second ends.

In another aspect of the invention, there is an intermodal well car having a pair of spaced-apart, longitudinally side extending beams. A well is defined between the side beams for accommodating intermodal shipping containers. A plurality of container support cross members extend between the side beams and upon which shipping containers may be carried. Cross-tie members extend between the side beams at locations between the container support cross members. One of said container support cross members has a first end and a second end, said first end having attachment fittings for connection to the first side beam of the well car, said second end having attachment fittings for connection to the second side beam of the well car, said one of said container support cross members having a hollow section, said hollow section being internally reinforced at said first and second ends thereof, and said one of said container support cross members having an externally extending diagonal strut connection and internal web continuity at said strut connection; one of said cross-tie members being mounted adjacent to, and spaced from, said one of said container support cross members, having a hollow section, and having an externally extending diagonal strut connection and internal web continuity thereat. A diagonal strut is mounted between said diagonal strut connections.

In another aspect of the invention, there is an intermodal well car having a pair of spaced-apart, longitudinally extending side beams. A well is defined the side beams for accommodating intermodal shipping containers. A plurality of container support cross members extend between the side beams. The shipping containers may be carried by the cross members. Cross-tie members extend between the side beams at locations between the container support cross members. One of said container support cross members is formed from a monolithic steel member having a first end and a second end, said ends being formed by bending the ends of said monolithic steel member to form toes, said first end having attachment fittings for connection to the first side beam of the well car in a moment connection, said second end having attachment fittings for connection to the second side beam of the well car in a moment connection, said one of said container support cross members having an externally extending diagonal strut connection mounted thereto. One of said cross-tie members is mounted adjacent to, and spaced from, said one of said container support cross members, having a hollow section, and having an externally extending diagonal strut connection and internal web continuity thereat. A diagonal strut is mounted between said diagonal strut connections.

DETAILED DESCRIPTION OF THE INVENTION

Figure 1A:
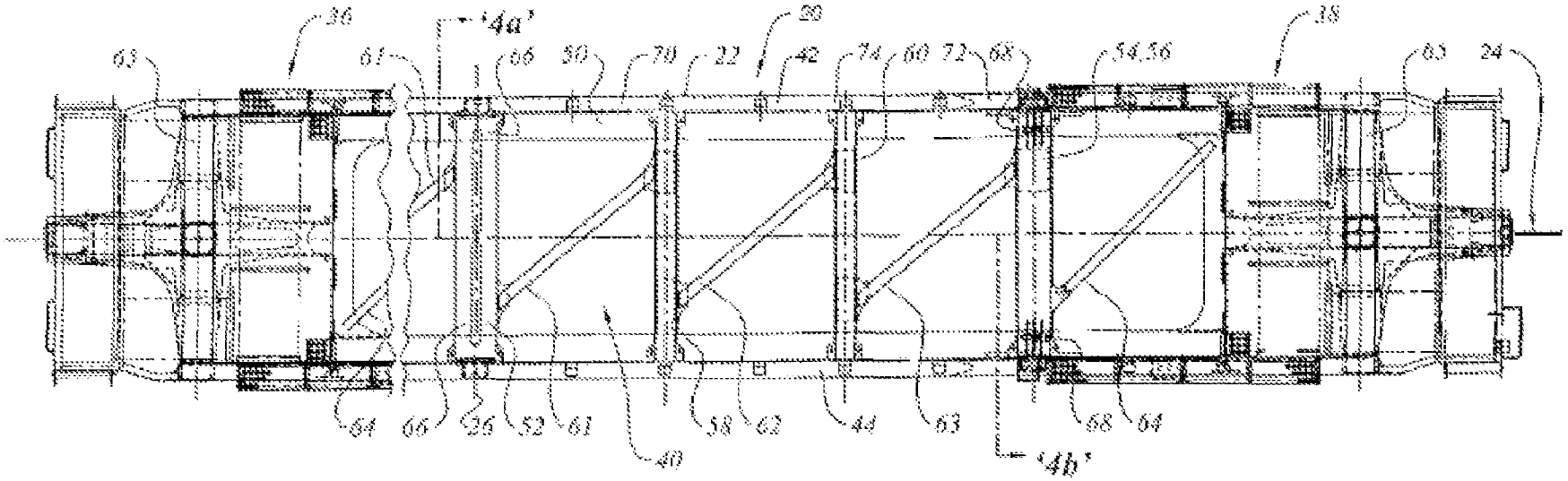
FIG. 1*a* shows a shortened top view of a rail road car of the present invention.

The description that follows, and the embodiments described therein, are provided by way of illustration of an example, or examples of particular embodiments of the principles of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated in order more clearly to depict certain features of the invention.

In terms of general orientation and directional nomenclature, for the rail road car described herein, the longitudinal direction is defined as being coincident with the rolling direction of the car, or car unit, when located on tangent (that is, straight) track. The longitudinal direction is parallel to the side sills. Unless otherwise noted, vertical, or upward and downward, are terms that use top of rail TOR as a datum. The term "lateral," or "laterally outboard," refers to a distance or orientation relative to the longitudinal centerline of the railroad car, or car unit, indicated as CL-Rail Car. The term "longitudinally inboard", or "longitudinally outboard" is a distance taken relative to a mid-span lateral section of the car, or car unit.

Figure 1B:
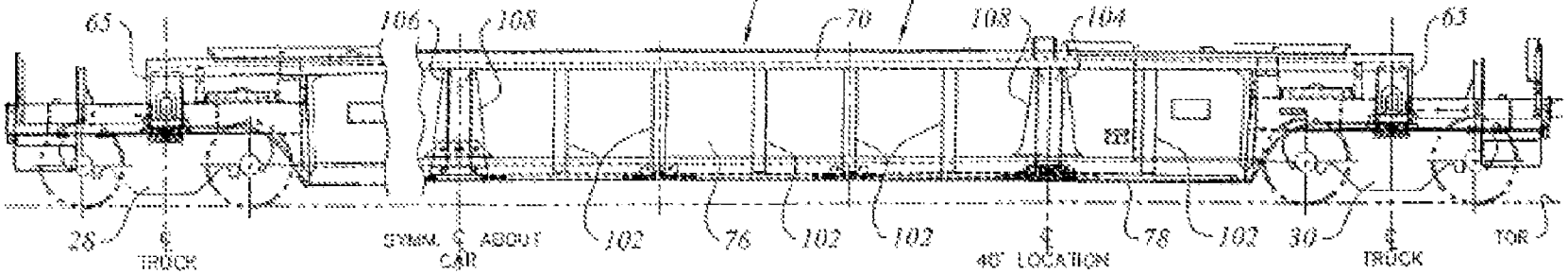
FIG. 1*b* shows a side view of a rail road car of FIG. 1*a;*

FIGS. 1*a* and 1*b* show a rail road car in the nature of a well car, indicated generally as 20. Other than as specifically indicated, the major structural elements of car 20 are symmetrical about the longitudinal axis of the car and also about the mid-span transverse axis. Rail road car 20 has a rail car body 22 supported upon a pair of rail car trucks 28 and 30, for rolling motion in the longitudinal direction (i.e., along the rails). A longitudinal vertical plane of symmetry running along the longitudinal centerline of car 20 is indicated as 24. A transverse plane of symmetry at mid-span between trucks 28 and 30 is identified as 26.

Rail car body 22 includes a pair of first and second, spaced apart end structures 36, 38 each mounted over a respective one of rail car trucks 28, 30; and a pair of opposed, spaced apart, parallel first and second, longitudinally extending, deep side beam assemblies in the nature of left and right hand longitudinally extending side beams 42, 44. Side beams 42, 44 are mounted to extend between end structures 36, 38. A well 40 is defined longitudinally between end structures 36, 38. Side beams 42 and 44 define sides of well 40.

A floor assembly 50, includes a first structural cross member in the nature of a main central container support cross beam 52 in the mid-span position that extends perpendicular to, and between side sills 42, 44; a pair of first and second end structural cross members in the nature of container support end cross beams 54 and 56 located at the "40 foot" locations roughly 20 feet to either side (in the longitudinal direction of car 20) of main cross beam 52; intermediate structural members, or struts, in the nature of intermediate cross-ties 58, 60; and diagonal cross-braces 61, 62, 63, and 64. Diagonal cross braces 61 to 64 co-operate with beams 52, 54, 56 and cross-ties 58, 60 to act as a shear transferring assembly, or web work structure, mounted between side sills 42, 44, for resistance to lateral loading of the car, as in cornering. The construction of cross beams 52, 54 and 56 which join side sill assembly 42 to side sill assembly 44, is described in greater detail below.

Within the allowance for longitudinal camber of car 20 generally, all cross members 52, 54, 56, 58 and 60 are preferably parallel to, and generally coplanar with, one another. When installed, center member 52 may be marginally higher than the other cross members 54, 56, 58 and 60. This nevertheless may still tend to permit the relatively level loading of intermodal cargo containers which are raised at one end by container cones 68 located on end cross beams 54 and 56.

Cargo loads, such as intermodal cargo containers or other types of shipping containers carried by rail car 20, are intended to be supported primarily, if not entirely, by cross members 52, 54 and 56. That is, it is not intended that vertical container loads due to gravity should be borne by either intermediate cross members 58, 60 or by diagonal braces 61 to 64. Container supports, or container locating cones 68 are located on end cross members 54 and 56. Cones 68 help to locate a container relative to cross members 54 and 56. The cross members 52, 54 and 56 are located so that the well 40 can accommodate either two 20 foot containers, each with one end located on cones 68 and the other end resting on center cross member 52, or a single 40 to 53 foot container, also located on cones 68 at either end. When supporting two 20 foot containers, an end of each container is supported by cross member 52. To accommodate these two container ends, cross member 52 is provided with load bearing portions, such as surface 66, of sufficient breadth to accommodate corner fittings of ends of two adjacent 20 foot shipping containers at the same time. That is, cross member 52 has a width at least as great as twice the width of the container corner fitting foot print plus an allowance for spacing between two adjacent containers carried back-to-back in the well. That is, width W is at least as great as 15 inches, and is preferably 17½ inches, or more than 17½ inches. As such, the center cross member 52 carries approximately half of the load in this configuration. The weight supported by cross member 52 may be further increased if more than one level of cargo container is carried, such as when two containers are stacked on one another.

Description of Side Beams

Figure 2:
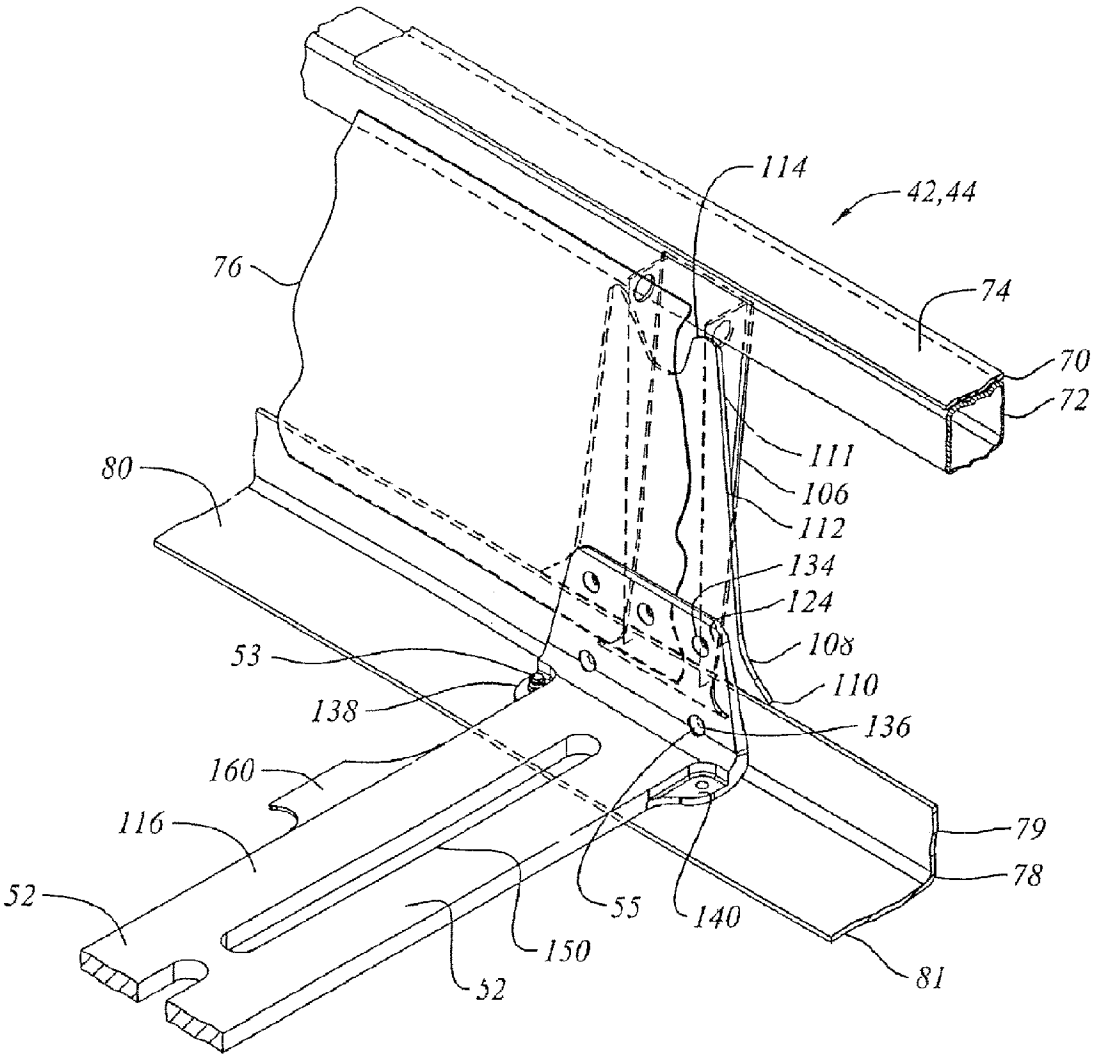
FIG. 2 shows a partial perspective view of the rail road car of FIG. 1*a* showing center cross beam connected to a side of said rail road car.
Figure 3:
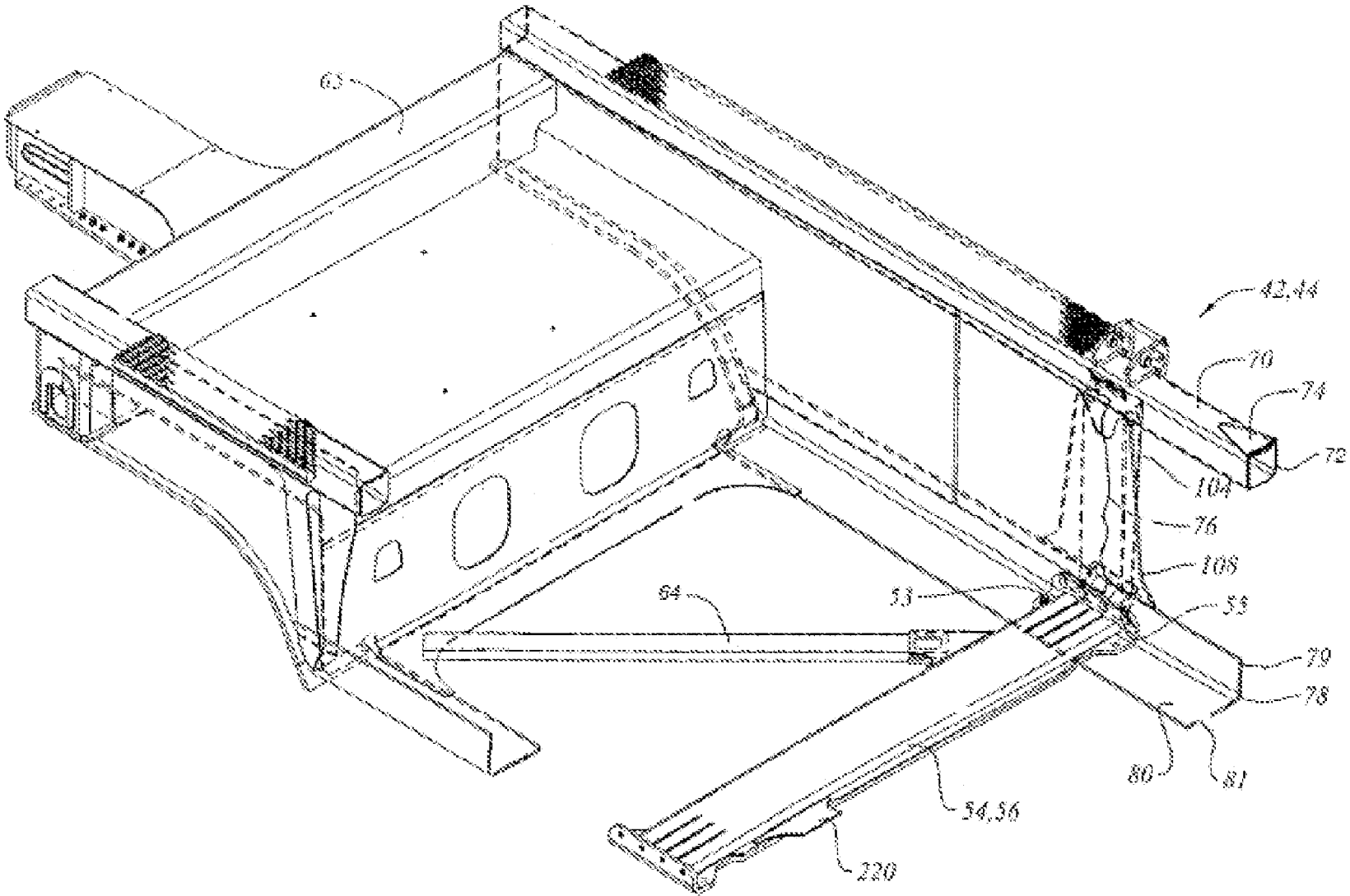
FIG. 3 shows a partial perspective view of the rail road car of FIG. 1*a* showing an end cross member and a diagonal strut connected to a side of said rail road car.

For the purposes of this description, the structure of one side beam is the same as the structure of the other side beam. Consequently a description of one side beam will serve also to describe the other. Referring to FIGS. 2, 3, and 4, the assembly of side beam 42 has an upper longitudinally extending structural member in the nature of a top chord member 70 in the form of a four sided hollow tube 72. A top chord doubler plate 74, of significant thickness (1" is preferred), is welded to the upper wall, or flange, of tube 72 and runs for about 35 feet along a central portion of top chord member 70 corresponding to the region of highest bending moment. In the preferred embodiment hollow tube 72 is a steel tube of square cross-section. A shear transfer member in the nature of a side sheet identified as web 76 is attached by a lap weld to, and extends downwardly from, the inner (i.e., laterally inboard) face of hollow tube 72. At its lower edge, web 76 is welded to a lower, longitudinally extending structural member in the nature of a side sill, namely bottom chord 78, preferably in the form of heavy angle 80. Bottom chord 78 has a vertical leg 79 to which web 76 is lap welded, and an inwardly extending toe 81. In one example, the length of toe 81 is such that the gap between it and the opposed toe 81 of the other side sill be less than 7'-0". As the gap is narrower than the container, the edge of toe 81 may tend to lie roughly 6 inches inboard (and underneath) of the edge of an 8'-0" wide container, when loaded.

Side sills 42, 44 each include an array of vertical support members, in the nature of stiffeners, or posts 102, that extend between bottom chords 78, and top chords 70. Side posts 102, have the form of steel channel sections welded along the outside face of side sill assembly 42, 44. The legs of the channel section are tapered from a wide top to a narrower bottom. The back of the channel stands outwardly from web 76, and the toes of the channel abut web 76 to form a closed hollow section. Side posts 102 are located abreast of, i.e., at longitudinal stations corresponding to, the longitudinal stations of the junctions of cross members 58, 60 with the side sills 42, 44, and also at longitudinal stations intermediate to the longitudinal stations of the cross beams and cross ties, and longitudinally outboard of cross beams 54, 56. The longitudinal pitch of the posts 102 is, preferably typically, about 40 inches from the next adjacent post.

End side post 104 has the form of a tapered channel mounted to side sills 42, 44 at longitudinal stations corresponding to the 40 foot container support positions, that is, adjacent to, or abreast of, the junctions of end cross members 54, 56 with bottom chords 78 of side sills 42, 44. Center side posts 106 each have the form of a fabricated tapered channel mounted toes-inward to side sills 42, 44 at locations corresponding to (that is, abreast of) the junctions of centre cross member 52 with side sills 42, 44 and, more particularly, with bottom chords 76 thereof.

Posts 104, 106 are of generally heavier section than the side posts 102. For example, in the embodiment illustrated in the FIGURES, post 102 may preferably have a wall thickness of about ¼"; a back width of about 5½"; and a leg depth tapering from 5¾" adjacent the top chord to about 2½" at the bottom end of the taper adjacent to the bottom chord. By contrast, reinforcing post 106 may preferably have a back width of about 10 inches, a leg taper from about 5¼ inches to about 4 inches, and a wall thickness of about ⅜ inches. Reinforcing post 104 may be a hat pressing preferably having a back width of about 10 inches, legs tapered from 5¼ inches adjacent to the top chord to 4 inches adjacent the bottom chord, and a wall thickness of about ¼ inch. Furthermore, a reinforcing member smoothly profiled doubler plate 108, is mounted to the outboard face of web 76, and underlies the footprint of the toes of post 104, or post 106 as the case may be. Thus the local cross-section of the side sills at the location of reinforced posts 104, 106 at mid height between the top chord 70 and the bottom chord 78 has a higher second moment of area for resisting lateral flexure of the top chords 70 than intermediate side posts 102. The difference in section reflects a difference in function, as described below.

Referring to FIGS. 1*b* and 2, the doubler plate 108 is generally planar and is sandwiched between web 76 and the center reinforcing post 106. A doubler plate 108 is also sandwiched between web 76 and the end reinforcing posts 104. The flared and radiused lower end of doubler plate 108 has a bottom linear edge 110 that abuts vertical leg 79 in the same region in which the end of cross member 52 is bolted through vertical leg 79. Linear edge 110 preferably extends beyond this area while still abutting with vertical leg 79. From its linear edge 110, doubler plate 108 tapers vertically upward toward a narrower upper end 111 that is wider than, and centered about, the reinforced side post 106, 104. The tapering edges 112 of the reinforcing member 110 may be generally concave and semi-parabolic. The end 111 may have a relatively small vertically oriented parabolic rebate 114 therein.

Side sills 42, 44 are mounted to end structures 36 and 38 at either end of car 20. End structures 36 and 38 each has a stub center sill having a draft pocket defined at its outboard end for mounting a railway coupler. A main bolster 65 extends laterally to either side of the stub sill. The distal tips of the main bolster being connected to the side beams structure. An end sill runs between the side sills and the outboard end of the stub sill. A shear plate overlies the end sill, and main bolster, and extends transversely outboard to the side sills.

Central Cross Member

Referring to FIGS. 5, 6*a*, 6*b*, 7, and 8, the center cross member 52 is formed from a monolithic piece of rolled steel plate, having a medial, or spanning portion 116 terminating at either end in first and second end portions having end attachment fittings in the nature of upwardly bent toes 118, 120 having bolt holes for attachment to the side sills. Center cross member 52 has a grain direction G running parallel to the longitudinal axis 51 of the cross member 52. When mounted in car 20, longitudinal axis 51 of cross member 52 extends transversely with respect to car 20 generally, that is, perpendicular to the central plane 24 of car 20. Spanning portion 116 has a generally rectangular shape and a substantially uniform thickness of about 2". Spanning portion 116 of cross member 52 has a width of roughly 17½", sufficient to accommodate the ends of two intermodal cargo containers, used when two 20 foot cargo containers are loaded end-to-end in well 40 of the car.

Figure 5:
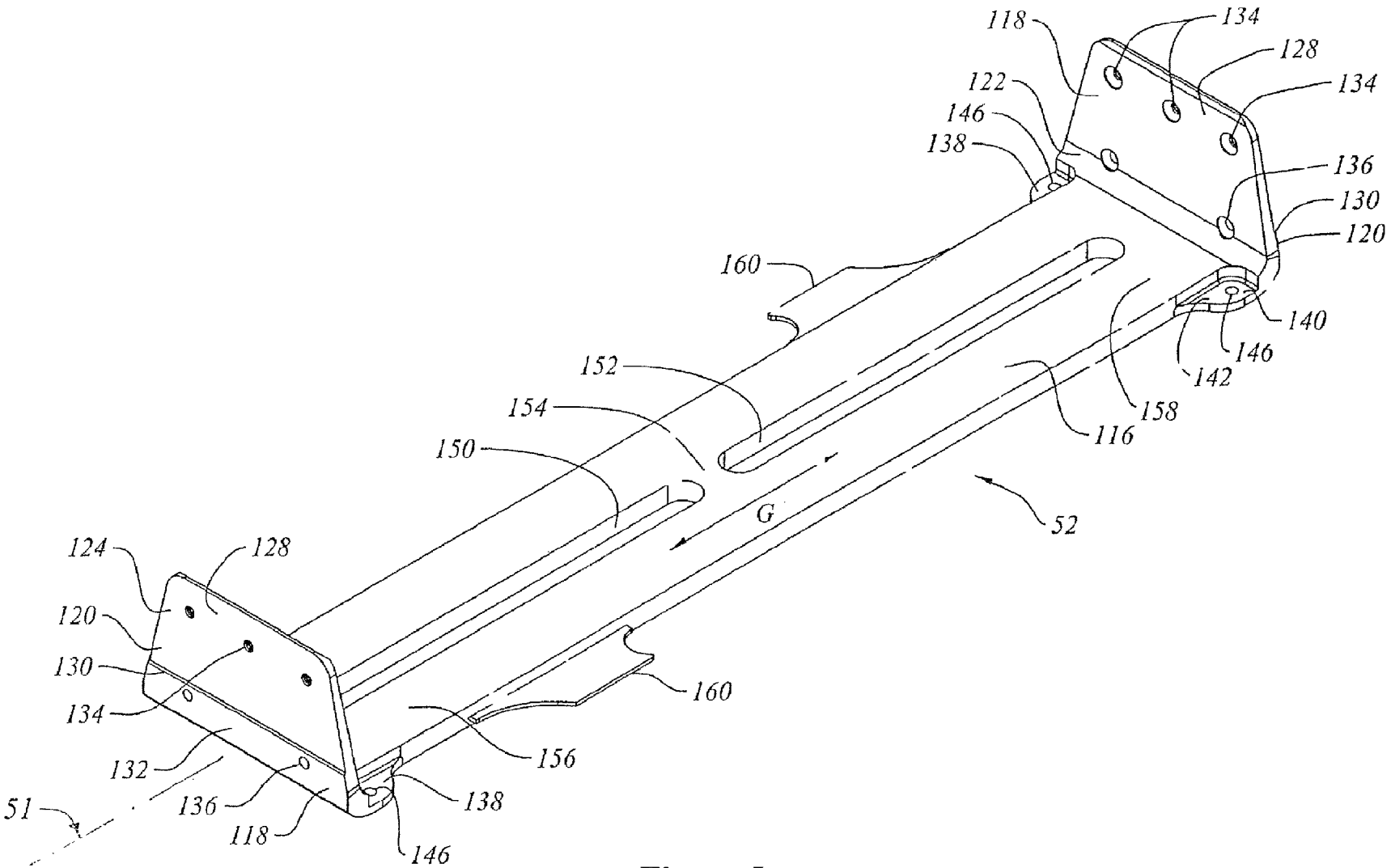
FIG. 5 is a perspective view of a center cross member of the rail road car of FIG. 1*a;*
Figure 6A:
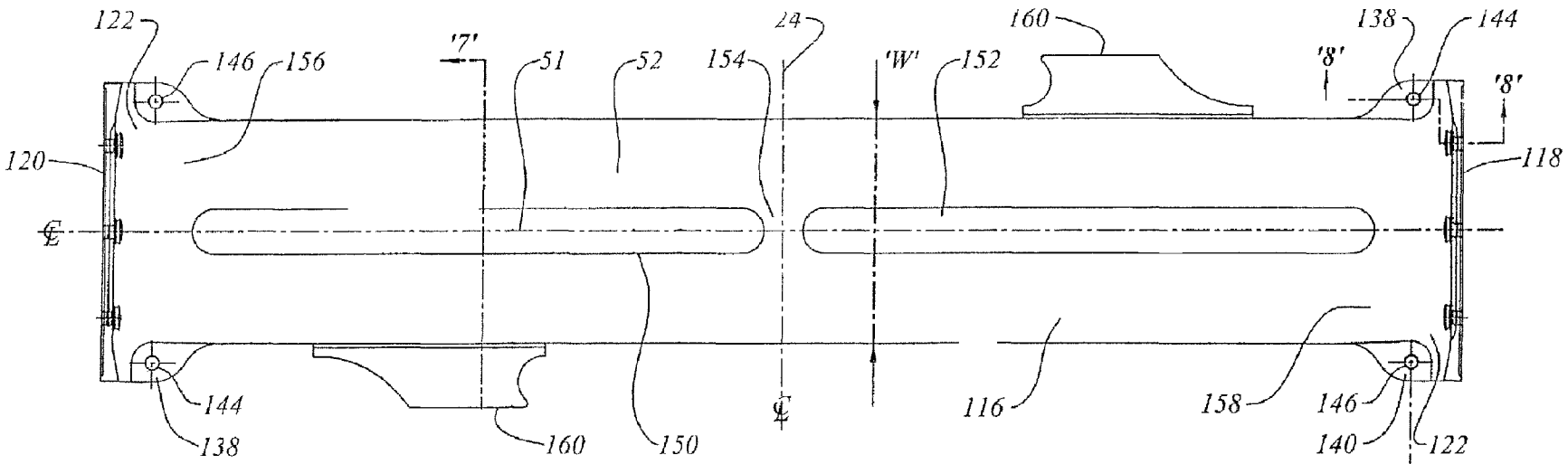
FIG. 6*a* shows a top view of the center cross member of FIG. 5.
Figure 6B:
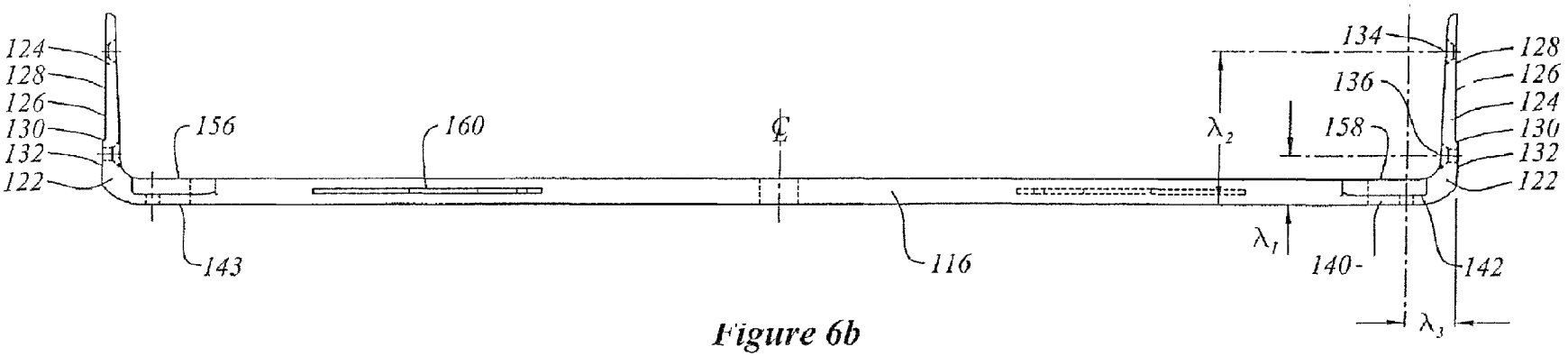
FIG. 6*b* shows a side view of the center cross member of FIG. 5.

Although toes 118 and 120 could be machined from a solid block, in the preferred embodiment they are formed by heating a lateral bend area, generally indicated as 122 in FIGS. 5 and 6*b*, of center cross member 52, the area 122 being proximate to each end of the center cross member 52. The bend area 122 is heated to a temperature typically between about 1300° F. and 1400° F., and preferably to about 1350° F. Center cross member 52 is then bent at the area of heating from an initial state as a flat monolith in the nature of a flat bar or plate, of desired profile, to form bent toes 118, 120. Center cross member 52 may then be left to cool to room temperature in still air. The edges of the center cross member 52 proximate to the bend area 122 may tend to bulge due to the bending process. As these bulges (not shown) may otherwise possibly tend to provide fatigue crack initiation sites, they are machined or ground flush to the edge of the center cross member 52, with the grinding marks being longitudinal with the grain G (FIG. 5). As formed, when viewed from the side (perpendicular to axis 51), cross member 52 has a U shape.

Toes 118, 120 each include an upwardly extending preferably trapezoidal flange 124 of tapering thickness for connection to the generally vertical side sills 42, 44. Bent toes 118, 120 project in the same direction, namely upwardly, when installed, and are oriented substantially normal to the longitudinal axis of cross member 52. Toes 118, 120 taper from a relatively thick root at bend area to a thinner, chamfered distal tip. The outboard surface 126 of the flange 124 is stepped, having a first, or distal portion 128 machined to present a planar surface normal to, (that is, perpendicular to) the longitudinal axis of the cross member 52 thereby providing an attachment interface surface for mounting against the lower portion of side sill web 76. Outboard surface 126 of the cross member 52 is machined to have a chamfered step 130 between distal portion 128 and proximal portion 132 to accommodate the overlap of side sill web 76 on the inside face of upwardly extending leg 79 of bottom chord 78. Proximal portion 132 provides another planar surface, in this case for placement directly against vertical leg 79 of bottom chord 78.

Figure 7:
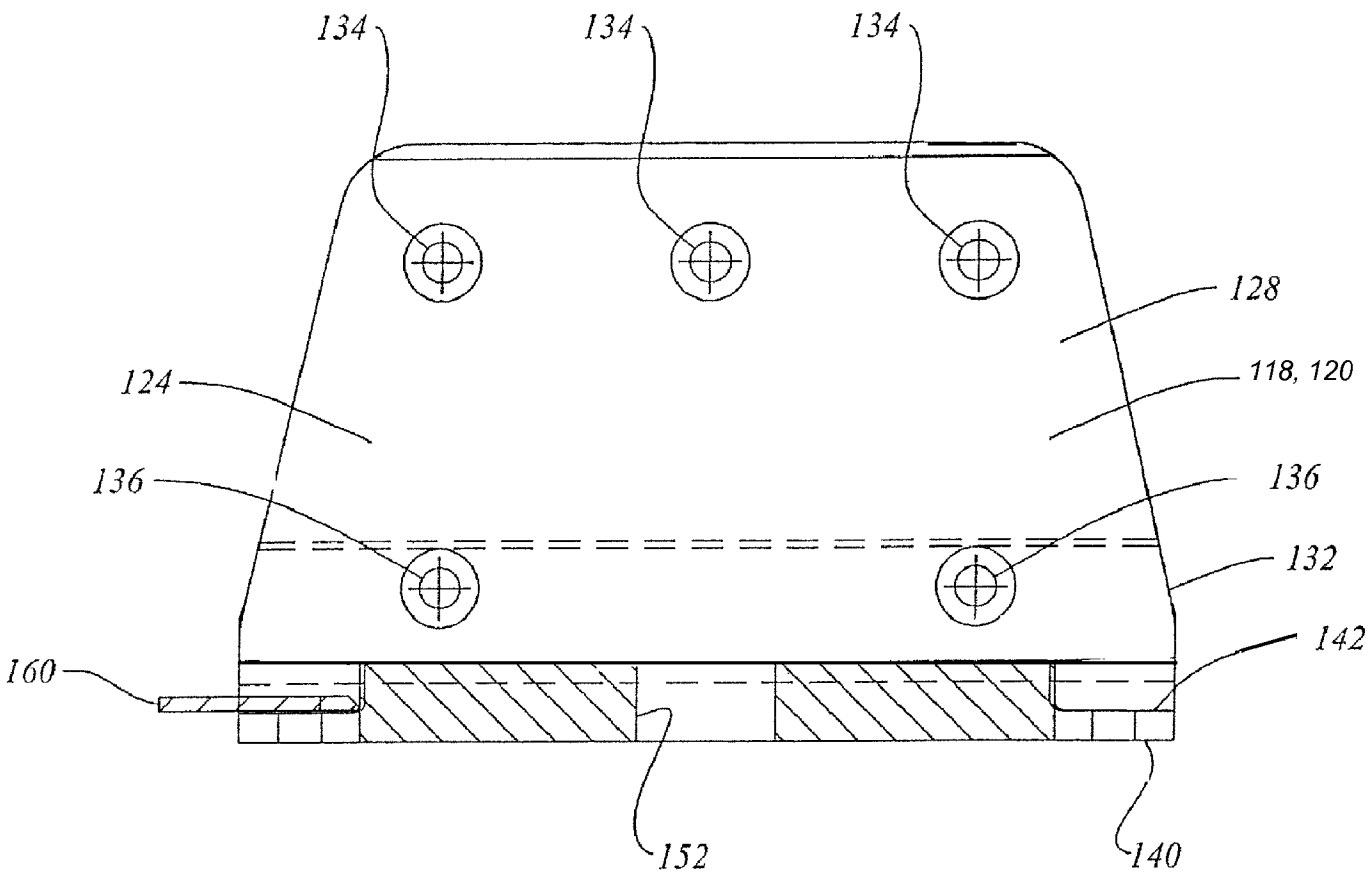
FIG. 7 shows a cross-sectional view of the center cross member taken on '7-7' of FIG. 6*a;*

Flanges 124 are also wider at the proximal end (that is, closer to the bend of bend area) as shown in FIG. 7. That is, the trapezoidal profile of toes 118, 120 narrows from a wider base adjacent bend area 122 to a narrower upper region at the distal tips of toes 118, 120. The attachment fittings each have a set of three countersunk through hole bores 134, formed in distal portion 128, and an additional pair of first and second countersunk through hole bores 136 formed in proximal portion 132. Countersunk bores 134 and 136 admit fasteners by which toes 118, 120 can be attached to side sills 42, 44 respectively by mechanical fasteners as opposed to welding. Although threaded fasteners such as high strength bolts or other fasteners such as rivets could be used, it is preferred to use Huckbolts™ for this connection.

Each end attachment fitting of cross member 52 has a pair of first and second machined ears, or lugs 138, 140 that extend to either side of a medial portion. Lugs 138 and 140 have a machined upper surface 142 for engagement by the head of a fastener, and a parallel machined lower planar surface 143 providing an engagement interface for placement against the upper surface of inwardly extending toe 81 of bottom chord leg 78. The rebate formed by machining the upper surface of lug 138, 140 provides a niche in which a mechanical fastener can seat shy of (that is, out of the way of items placed on) the plane of the upper surface presented by cross member 52 to the bottom of shipping containers. Lugs 138, 140 are smoothly radiused to merge into the body of spanning portion 116 more generally. Lugs 138 and 140 are generally coplanar, and are provided with through bores 144, 146 by which a bolted connection can be made. Rivets or other mechanical fasteners could be used, but high strength Huckbolts™ are preferred. Lugs 138 and 140 merge at the bent region with the transverse end vertical flange, namely flange 128. The end portion measured across lugs 138, 140 is thus wider than the adjacent spanning portion of beam 52.

To reduce weight, a pair of slots 150, 152 may be machined in spanning portion 116, as shown in FIGS. 5 and 6*a*, the long dimension of the slots running parallel to the longitudinal centerline of the cross member 52. Slots 150, 152 preferably pass clear through cross member 52 and, in the preferred embodiment are about 3" wide and 45" long. Slots 150, 152 are separated by web bridge at mid-span, indicated as 154, web bridge 154 being preferably about 3" wide. The upper surface of cross member 52 includes first and second end regions that present a container support interface in the nature of first and second planar surface portions 156, 158 of sufficient width to accommodate end corner fittings of two 20 foot containers carried end-to-end in well 40.

Cross member 52 also includes a pair of first and second diagonal brace fittings in the nature of strut root transition plates 160 welded to opposite sides of central portion 116 near to respective toes 118, 120. Transition plates 160 are gusset-like plates that provide a surface to which an end of diagonal member 61 can be welded at the oblique, diagonal angle of FIG. 1, and provide a flared and radiused end (a fatigue detail) by which the forces carried in diagonal member 61 may tend to be passed effectively and gradually into member 52.

Both strut root transition plates 160 have concave arcuate portions adjacent to the proximal end of the flange, with the arcuate portion opening towards the lateral centerline of the cross member 52. Both the first and second strut root transition plates, as described above, may be similar in shape and orientation to those illustrated and described below for the end cross members 54, 56.

Figures 4A, 4B:
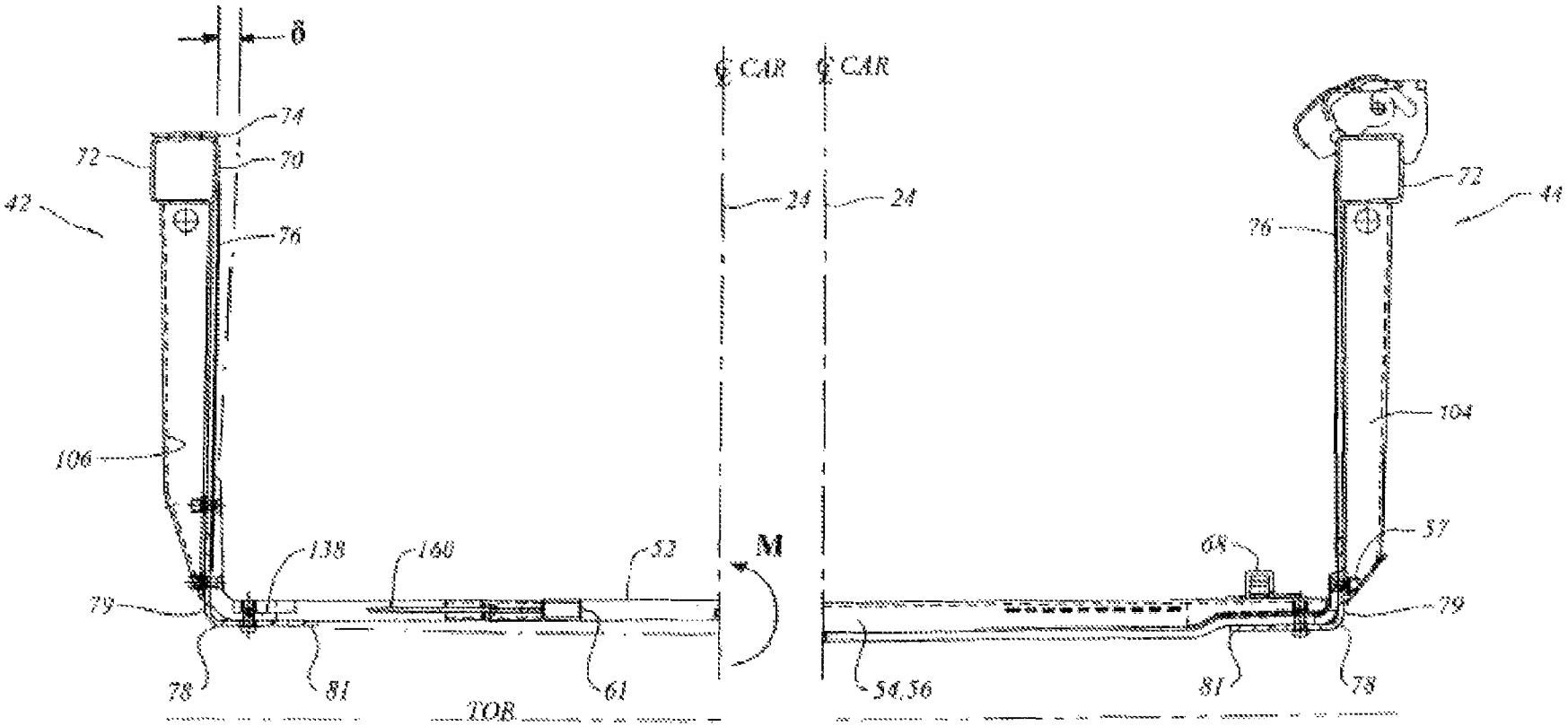
FIG. 4*a* shows one half of a cross-sectional view of the railroad car of FIG. 1*a* showing a mid-span cross member taken on the half section at arrow '4*a*' of FIG. 1*a;*
FIG. 4*b* shows one half of a cross-sectional view of the railroad car of FIG. 1*a* showing an end cross member taken on the half section at arrow '4*b*' of FIG. 1*a;*

Cross member 52, (FIG. 2) is preferably installed by inserting a fastener such as item 53 (preferably a Huck-bolt™ for mating connection with item 55, preferably a Huck-bolt collar) through the various bores 134, 136, 144, 146 to provide a rigid connection between cross member 52 and side beams 42, 44. The connections made through bores 134, 136, 144, 146 may tend to permit the transmission of moment between side beams 42, 44, cross member 52 and center post 106, (FIG. 4*a*). While a welded connection could also be used, a mechanically fastened connection is preferred.

However, a bolted connection is normally preferred over welding in such cases to reduce the likelihood of fatigue cracks that may develop in the connection. When installed, cross member 52 overlaps with inwardly extending toe 81 of bottom chords 78. This overlap permits the bottom chord 78 to help support a vertical load placed on the cross member 52, particularly when the load is placed on load bearing surface portions 156, 158 of the cross member 52 for supporting a shipping container.

End Cross Members

End cross beam members 54 and 56 are shown in FIGS. 9, 10*a*, 10*b*, 11, 12 and 13. End cross beam members 54, 56 are identical in configuration, such that a description of one will also serve to describe the other. End cross beam member 56 includes a first beam member in the nature of a monolithic lower plate 170 and a second beam member in the nature of a formed cover plate 172 having the cross-section of a formed C-channel mounted to monolithic lower plate 170 to form a beam of hollow closed section. Although a beam of solid section could be used, it is preferable to employ a hollow section, as shown. A portion of monolithic lower plate 170 forms a first flange portion 174, (that is, the lower flange of end cross beam member 56), and a portion of cover plate 172 forms a second, upper flange portion 176 of the cross member 56. The second flange portion 176 is spaced from the first flange portion 174 to co-operate to resist vertical flexure of the cross member 56. The vertical bent legs 175 of plate 172 form vertical webs connecting portions 174 and 176. End cross member 56 preferably has a generally rectangular shaped section, and, over the mid-span portion of the section, preferably has a substantially uniform thickness. In one embodiment this thickness may be about 3⅞".

Lower plate 170 has first and second end portions 178, 180 and a medial portion 182 lying therebetween. Monolithic plate 170 is bent at 171 such that end portions 178, 180 have end fittings in the nature of upwardly bent toes 184, 186 having vertically extending flanges 192 suited for installation, that is placement, against the inwardly facing surface of upwardly extending leg 79 of bottom chord, 78. Bent toes 184, 186 each have mounting fittings in the nature of a set of four spaced apart countersunk through hole bores 218 to facilitate connection of toes 184, 186 to the upward leg of the side sills of side beams 42, 44 respectively.

End portions 178, 180 also include a horizontal portion 188 that, in plan view, has a wide portion 190 immediately adjacent to bend 171, and a narrower portion 194 extending away from bend 171 to an inclined step 196 at which end portions 178, 180 meet medial portion 182. Horizontal portion 188 provides a planar interface surface 189 for engaging, that is, seating upon, the upper surface of inwardly extending leg 81 of bottom chord 78. The transition from wide portion 190 to narrow portion 194 occurs along a smoothly radiused taper 198 which merges with narrow portion 194. The wings of wide portion 190 stand, symmetrically, wider relative to beam centerline 200 than the outer edges 204 of narrow portion 194 define mounting fittings, or lugs 202. Lugs 202 each have a countersunk through bore 206 by which lugs 202, and hence wide portion 190, can be fastened to bottom chord 78 by means of mating fasteners such as indicated by items 55 and 57. In the preferred embodiment item 55 is a Huck-bolt, and item 57 is a Huck-bolt collar. Alternatively, bolts and nuts or formed rivets could be used.

Upper plate 172 is formed from a steel plate having longitudinally extending margins bent at right angles to form a downwardly opening channel section 208. The legs 175 of channel section 208 are trimmed to accommodate the step in lower plate 170 with which channel section 208 mates, and is welded to, lower plate 170. Legs 175 then form the webs of a box section. In the embodiment illustrated, upper plate 172 is narrower and shorter than closure plate 170. Closure plate 170 is welded at either end to the vertically extending flanges of bent toes 184, 186.

Channel member 208 has an array of at least one, and preferably three, longitudinal slots 214 formed therethrough. Slots 214 are located adjacent to each of the terminal flanges 192. In the embodiment illustrated, flat bars 216 are mounted, by welding, to the upper face of end portion 178, 180 of lower plate 170. Slots 214 are narrower than flat bars 216 such that slots 214 permit flat bars 216 to be welded to the end portion of top plate 172. The region of end plate 172 above, and supported by, flat bars 216 provides a container support interface 217 upon which the corner fittings of containers can rest. Container cones 68 (FIG. 4*b*) are mounted at the container support interface above flat bars 216. Flat bars 216 provide support to the otherwise hollow section of upper plate 172 at the end locations, and may tend to bear a vertical compressive load to discourage the hollow end portion of upper plate 172 from collapsing under the relatively concentrated vertical load at the container corner.

Four countersunk bores 218, pass through each flange 184, 186 for receiving fasteners such as high strength bolts 53 to fasten cross member 56 to vertical leg 79 of bottom chord 76. In the present embodiment flange 124 of center cross member 52, flange 184, 186 does not extend beyond vertical leg 79, however it can also be extended and fastened in a way similar to the center cross beam 52. Bores 218 are spaced apart and located adjacent the base of flange 184, 186. Although four bores are shown, as few as one bolted connection, or more than four bolted connections could be used. As illustrated, bores 218 are offset from the horizontal plane of the downwardly facing planar interface surface 189 of horizontal portion 188.

Cross member 56 is preferably installed by inserting bolts through bores 206, 218 to provide a rigid moment connection between cross member 56, side sill 42, 44, and end post 104, (FIG. 4*b*). The connection made through bores 218 may be used to transmit a moment at the inwardly extending toe 81 of the bottom chord 78. The bores 206 serve to strengthen this connection to transfer moments at the vertical leg 79 and side post 104. In the above configuration, moments may be effectively transferred between the structural elements of the railcar 20 in both the horizontal and vertical planes to resist deflection of the top chords 70 in a direction transverse to the longitudinal direction.

A mechanically fastened moment connection is preferred over welding because a bolted connection may tend to reduce the likelihood of a fatigue crack forming in the connection. Mechanical fastening may tend to facilitate the removal and replacement of damaged or worn cross members. When installed, end portions 178, 180 of cross member 56 overlap with the inwardly extending toe 81 of bottom chords 78. This overlap permits bottom chord 78 to help support a load placed on cross member 52.

Cross member 56 has a diagonal strut connection plate 220, having a generally similar profile to strut root transition plate 160, and is mounted to extend outwardly from the vertical sidewall 175 of cover plate 172. Web continuity is provided at the same level by welding an internal web plate 222 within cover plate 172 in line with diagonal strut connection plate 220. A second diagonal strut connection plate 224 is mounted to extend from the opposite side of beam member 56 at the level of the flange of lower plate 170.

Intermediate Cross-Ties

Referring to FIGS. 14, 15*a*, 15*b*, and 15*c*, intermediate cross members 58, 60 are having turned up toes, or end flanges, 226, 228. Intermediate cross members 58, 60 are basically closed cross-section, built up beams. Cross members 58, 60 have widened ends with ears, or lugs with bores to permit fastening to toes 81 of bottom chord 78, and additional bores to permit bolting of the upturned end flanges to leg 79 of bottom chord 78. Cross members 58, 60 have diagonal brace strut root members 230, 232 and internal gussets 234 for web continuity at the strut roots. The cross-section is of much lighter construction than central cross beam member 52 or either of end cross members 54, 56. It is not intended that cross-ties 58, 60 be capable of supporting container corner loads.

Diagonal Bracing

In the embodiment illustrated, cross braces 61 to 64 are attached to the cross member 52, as described above. Cross braces 61 to 64 can be connected by welding directly to respective cross members 52, 54, 56, 58 or 60 by means of connection plates 160, 220, 224, 230 or 232 located along a side of the respective cross members. Flange 160 (or such as may be the case) is either attached to, or integral with, the side of the longitudinal portion 116, and is oriented to be generally coplanar with the longitudinal portion 116.

Connection of Cross Beams to Side Sills

Figure 8:
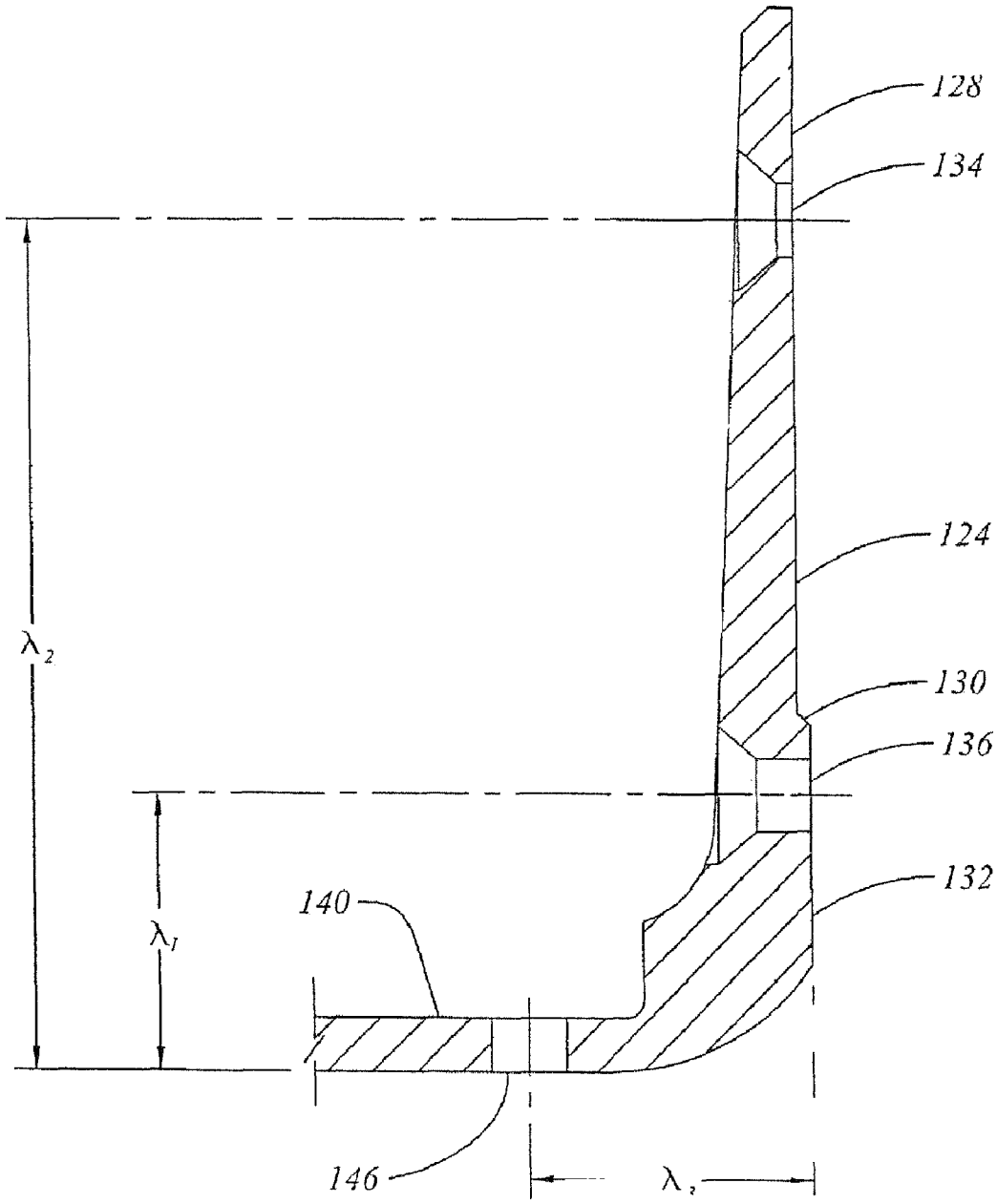
FIG. 8 shows a cross-sectional view of the center cross member taken on '8-8' of FIG. 6*a;*
Figure 9:
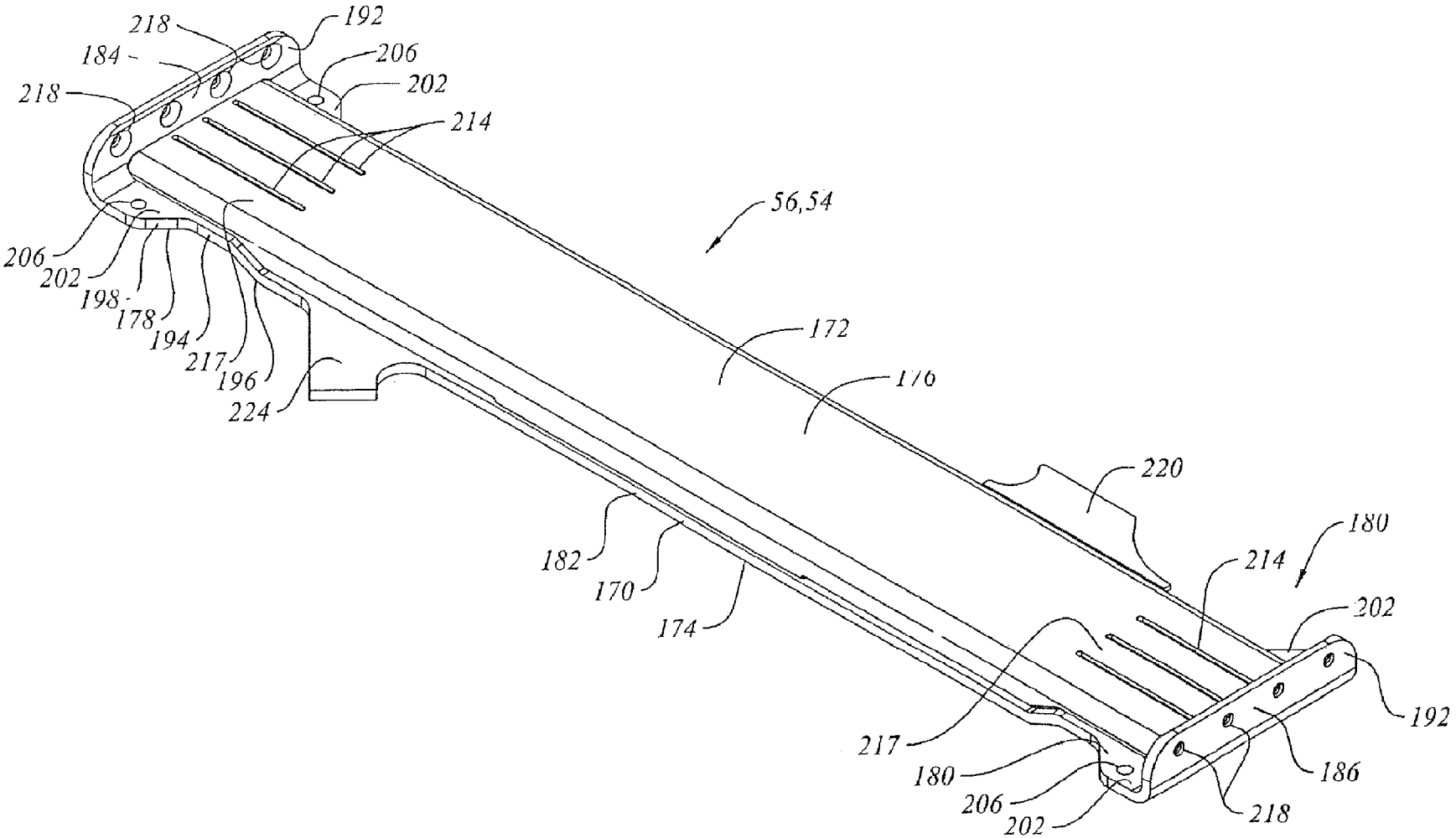
FIG. 9 is a perspective view of an end cross member of the rail road car of FIG. 1*a;*

Bottom chord 78 has bores in the nature of bolt holes located at the mid-span and 40 foot container locations to permit cross members 52 and 54, 56 respectively to be bolted into position. The inboard surface of the upwardly extending leg 79 of bottom chord 78 lies in a first, vertical plane. The upward face of the second, laterally inboard extending leg 81 of bottom chord 78 lies in a second, horizontal plane. These first and second planes intersect along a longitudinal line of intersection. In the case of mid-span central cross beam 52, the bolted connection includes a pair of bolts inserted through bores 136 lying at a first distance (that is, a vertical offset distance measured from the line of centers of the bolts) from the line of intersection of the planes by a first distance $\lambda_1$, (FIGS. 8 and 6*b*). The bolted connection also includes a second set of bolts 55 inserted through bores 134 lying at a second distance $\lambda_2$ from the line of intersection of planes, (FIG. 8). The bolted connection includes a third pair of bolts inserted through bores 146 located to bolt the side flanges of cross beam 52 to horizontal leg 81 of bottom chord 78, the bolts having a line of centers offset from the line of intersection of the planes a distance $\lambda_3$ (that is, a horizontal offset distance), (FIG. 8).

Figure 10A:
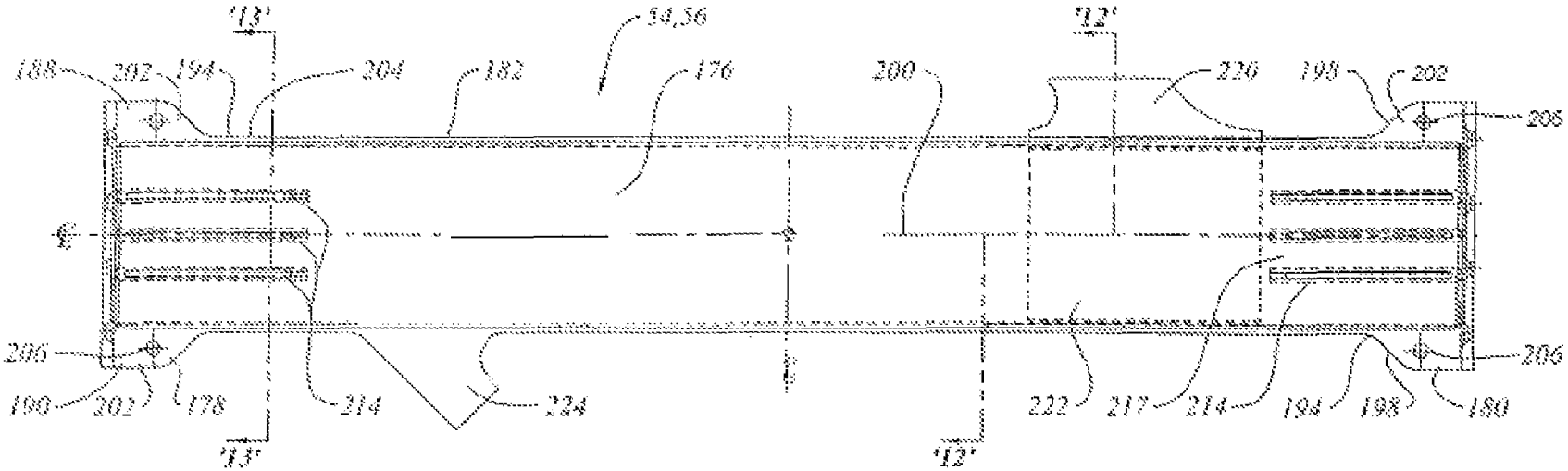
FIG. 10*a* shows a top view of the end cross member of FIG. 9.
Figure 10B:
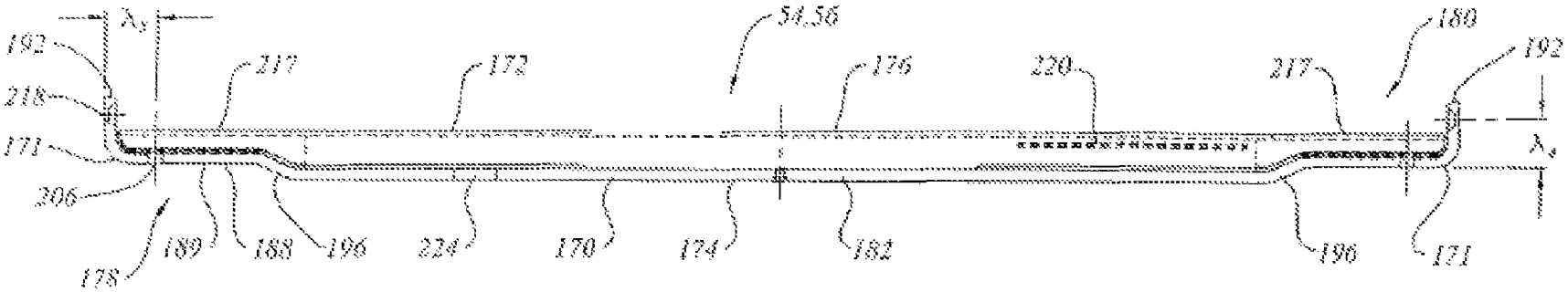
FIG. 10*b* shows a side view of the end cross member of FIG. 9.
Figure 11:
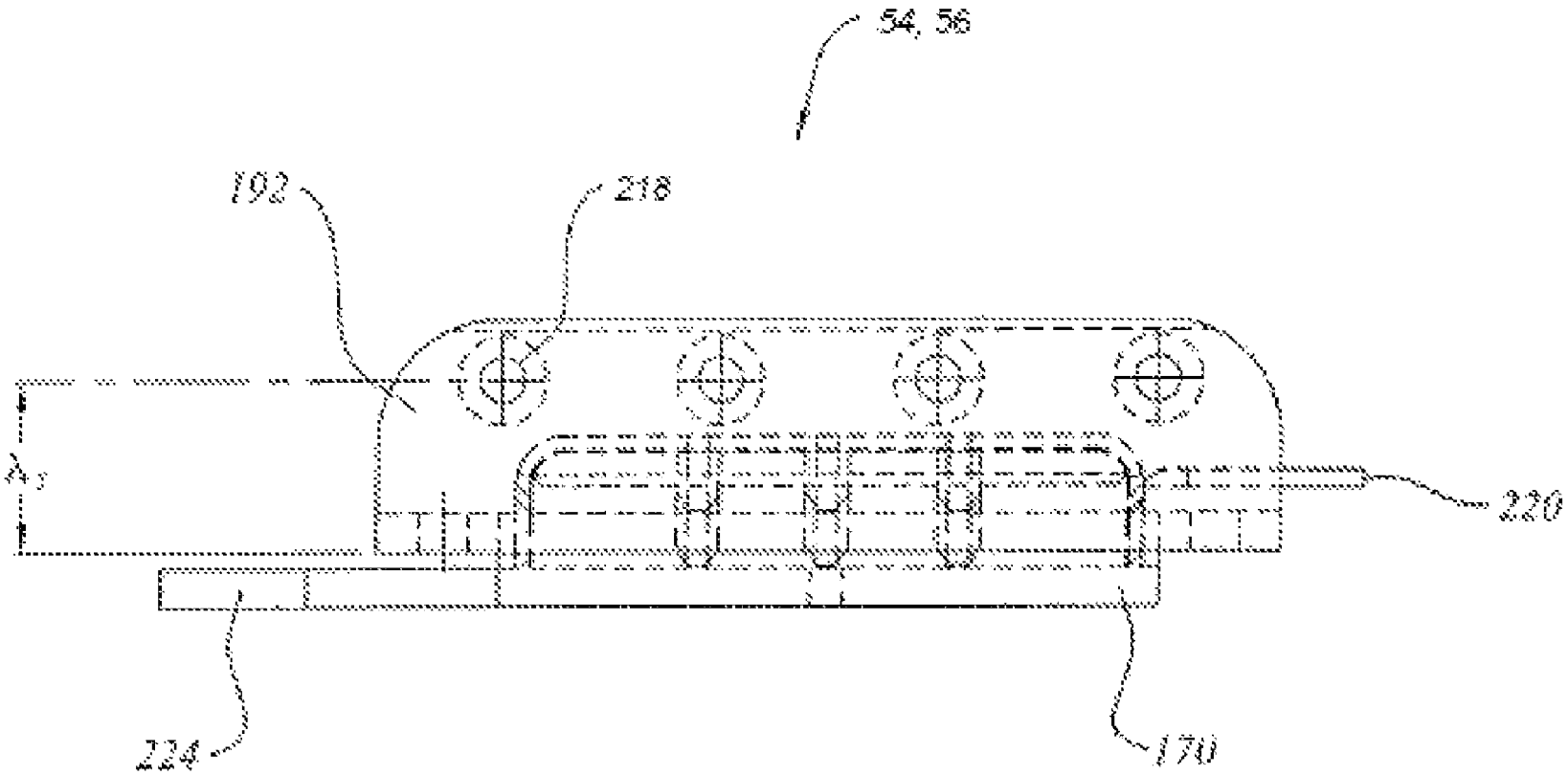
FIG. 11 shows an end view of the end cross member of FIG. 9.
Figure 12:
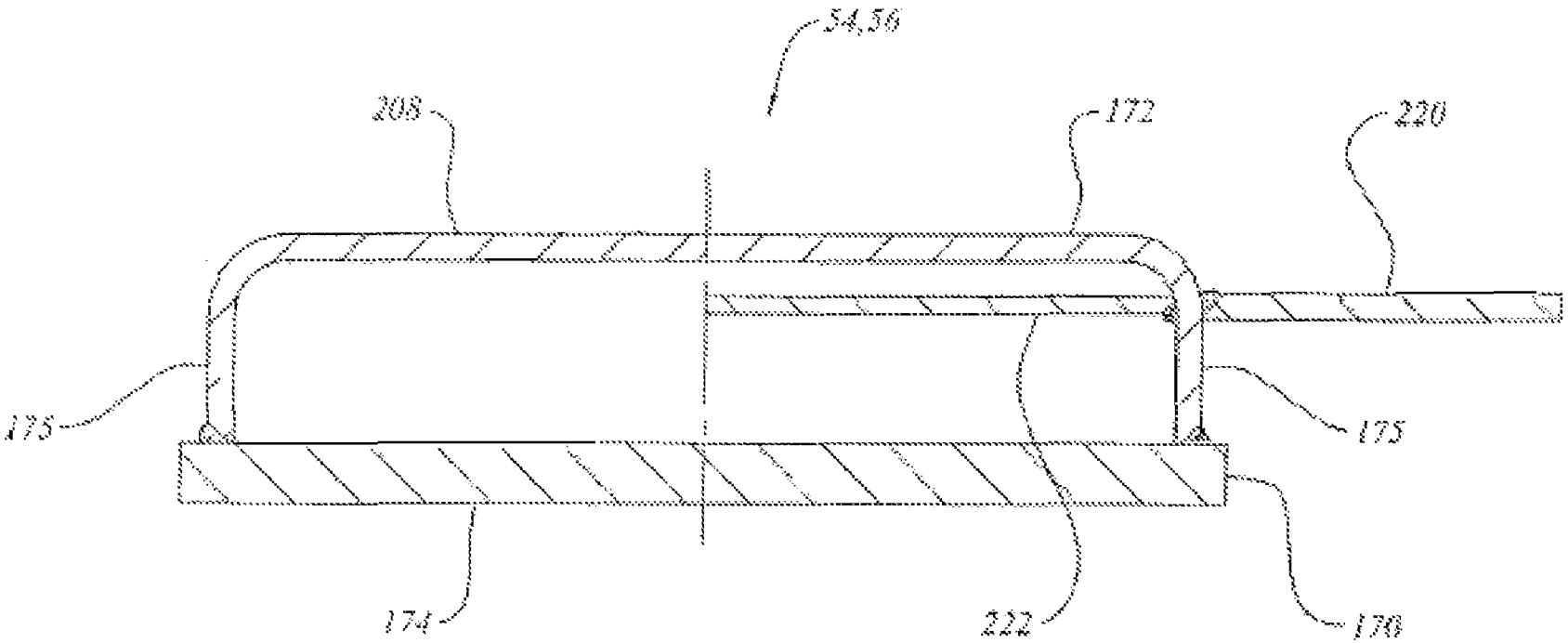
FIG. 12 shows a cross-sectional view of the end cross member taken on '12-12' of FIG. 10*a;*
Figure 13:
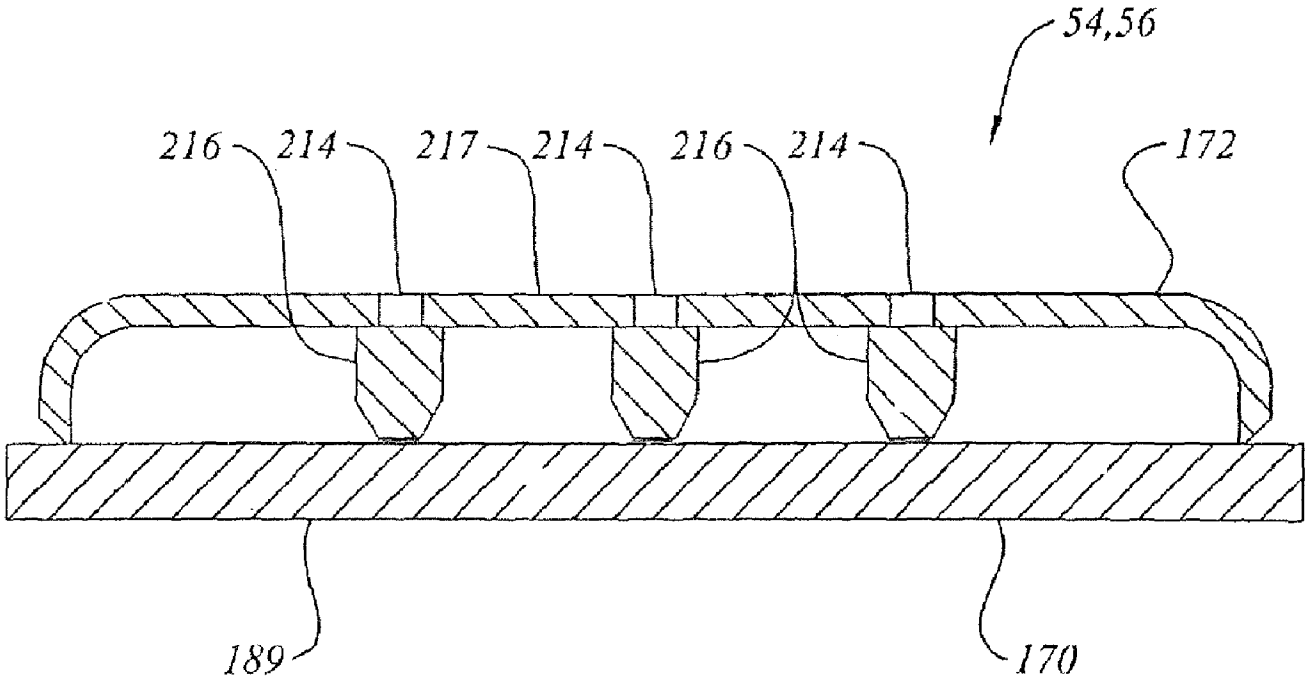
FIG. 13 shows a partial cross-sectional view of the end cross member taken on '13-13' of FIG. 10*a;*
Figure 14:
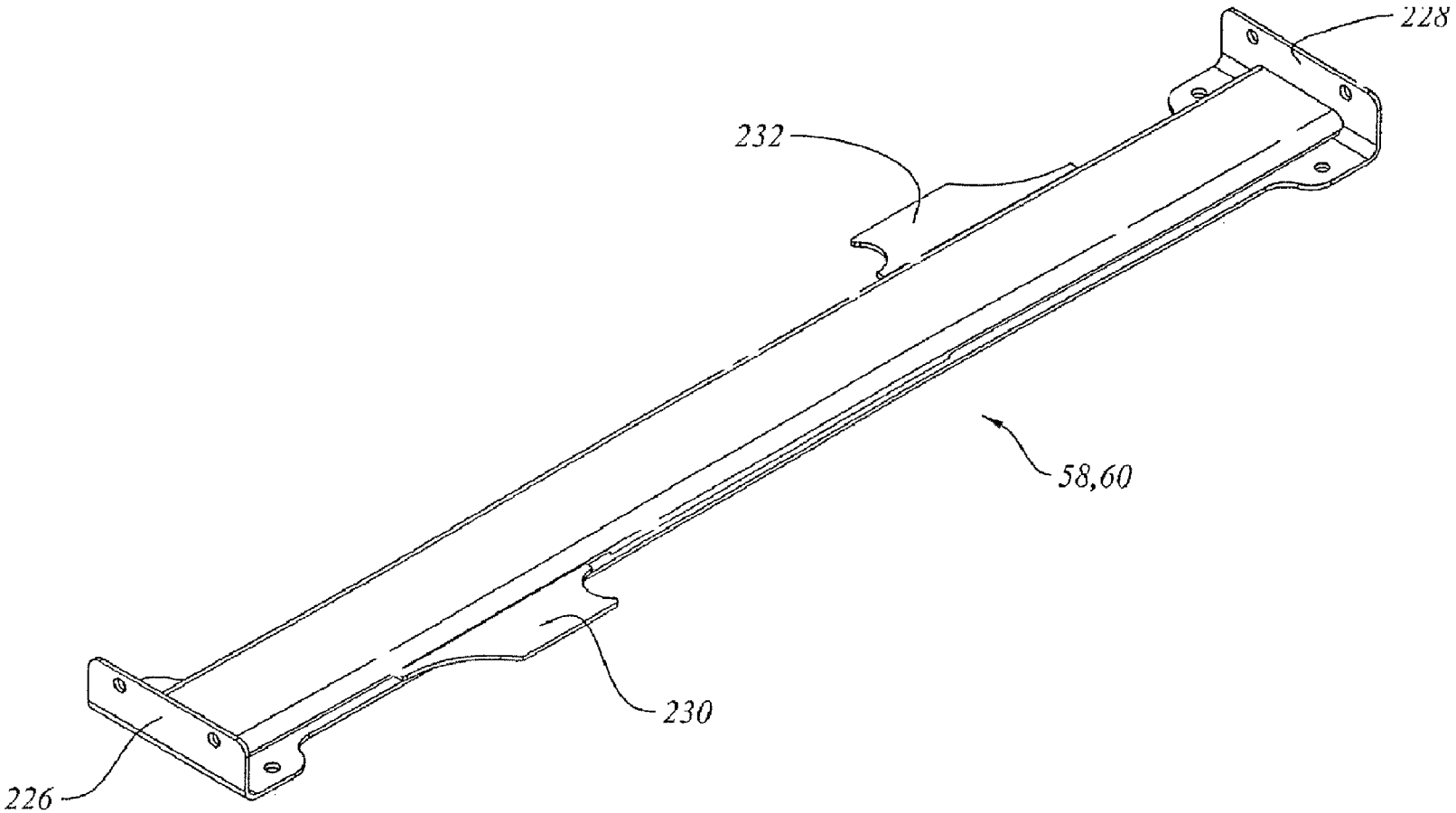
FIG. 14 shows a perspective view of the intermediate cross member of FIG. 1*a;*
Figure 15A:
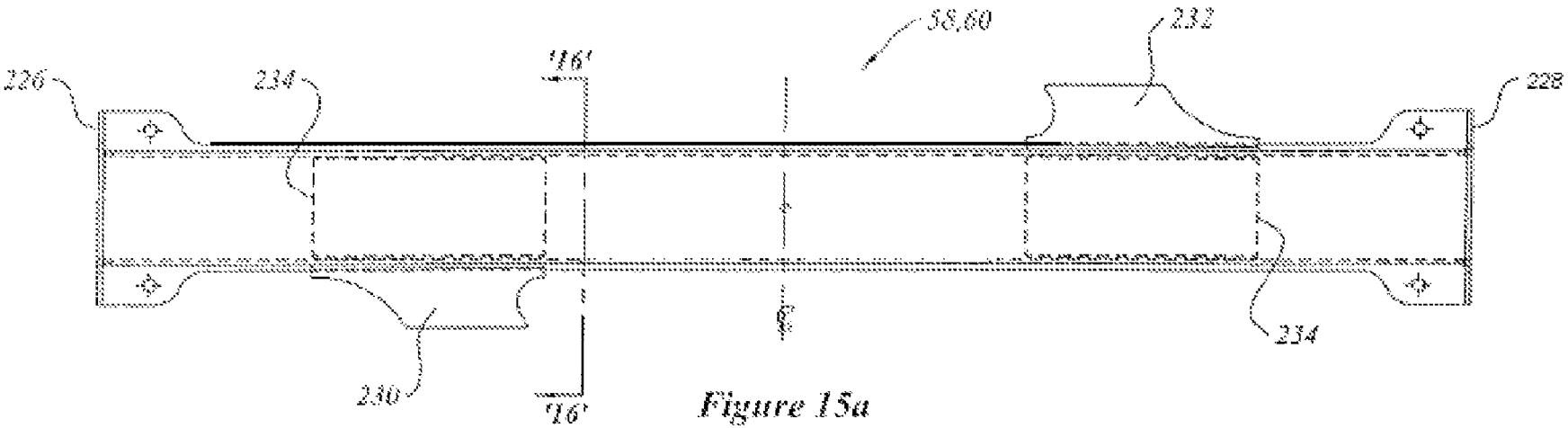
FIG. 15*a* shows a top view of the intermediate cross member of FIG. 1*a;*
Figure 15B:
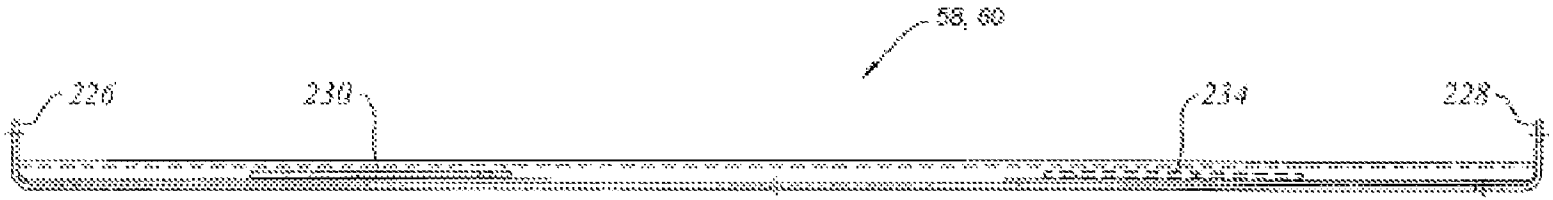
FIG. 15*b* shows a side view of the intermediate cross member of FIG. 15*a;*
Figure 15C:
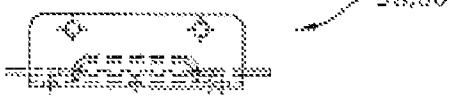
FIG. 15*c* shows an end view of the intermediate cross member of FIG. 15*a;*
Figure 16:
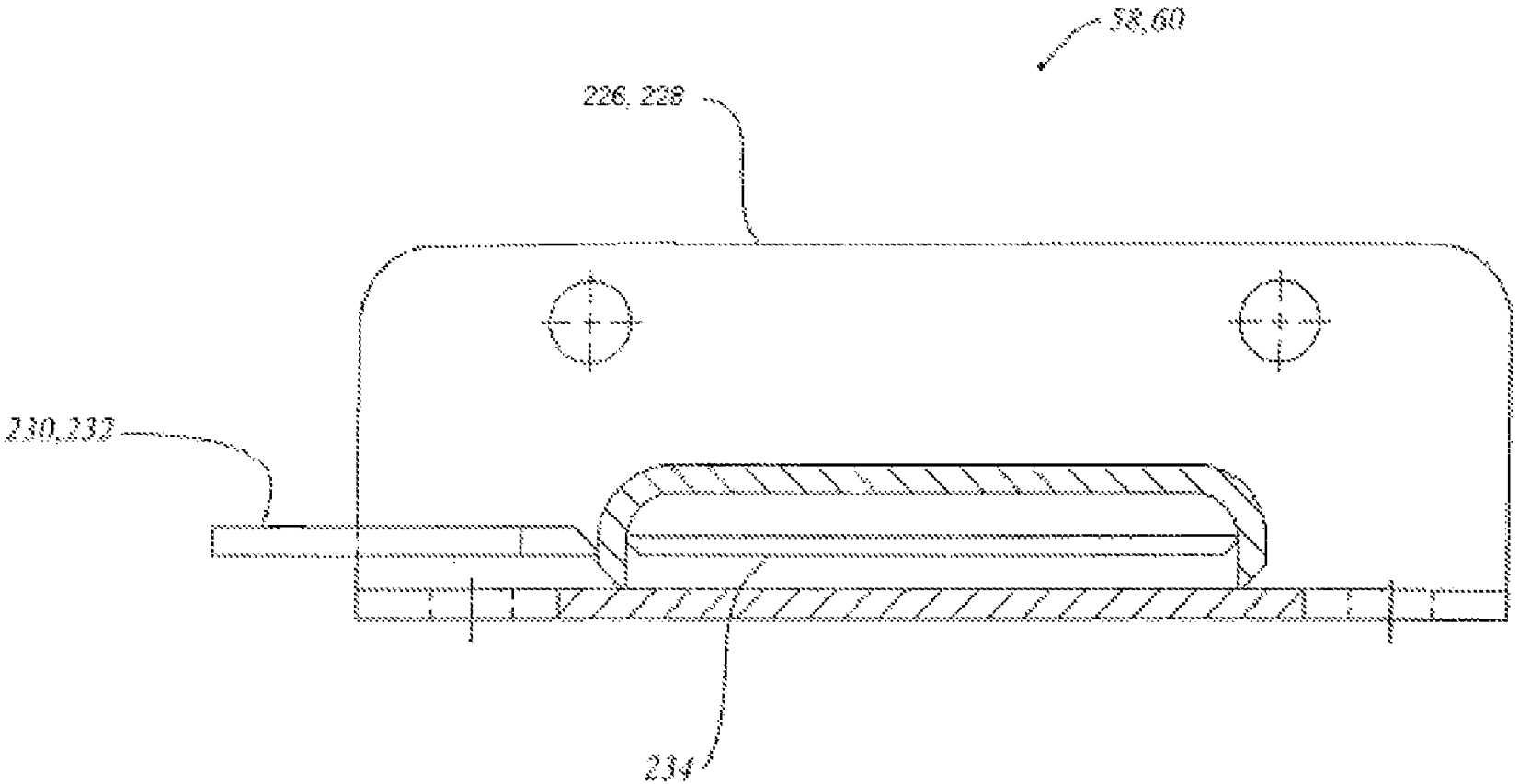
FIG. 16 shows a cross-sectional view of the intermediate cross member taken on '16-16' of FIG. 15*a;*

Similarly, in the case of 40 foot cross beam 54 or 56, the bolted connection includes a set of four bolts inserted through bores 218 lying at a distance (that is, a vertical offset distance measured from the line of centers of the bolts) from the line of intersection of the planes by a first distance $\lambda_4$, (FIG. 10*b*). The bolted connection also includes another pair of bolts inserted through bores 206 located to bolt the side flanges of cross beam 54 (or 56) to horizontal leg 81 of bottom chord 78, the bolts having a line of centers offset from the line of intersection of the planes a distance $\lambda_5$ (that is, a horizontal offset distance) (FIG. 10*b*).

The reinforcement of posts 104 and 106 relative to post 102, and the use of doublers 108 reflects a difference in function, (FIG. 1*b*). Posts 102 serve to discourage buckling of web 74. Posts 104 and 106 are connected to cross beams 54 and 52, respectively, by the bolted moment connection at bottom chord 78. As such, to the extent that top chords 70 may have a tendency to deflect inward toward each other under longitudinal compressive loads, the bending moment so induced will tend to be transmitted through the bolted connection and into cross beams 52 and 54, 56. Cross-beams 52 and 54, 56, being of significant section, will tend to resist this bending moment, such that the entire assembly of cross beam 52, and side posts 106 and doubler 108 (or, alternatively, cross beam 54 or 56 and side posts 104 and doublers 108) acts as a U-shaped spring operable to resist, or control, lateral deflection of the top chords under longitudinal compressive (i.e., buckling) loads applied to the ends of the car, (FIG. 4*a*).

Operation of Elements

When rail car 20 is under a combined end-wise compressive load and vertical container loads, side beams 42, 44 are compressed longitudinally and tend to act as eccentrically loaded columns. As a result, top chords 70 may have a tendency to want to buckle under the load. In buckling, the side beams 42, 44 may tend to want to twist, or rotate, as indicated in FIG. 4*a*, and top chord 70 may tend to deflect laterally inboard relative to well 40 of railcar 20. This deflection may tend also to be accompanied by deflection of connected web 76, and side posts 104 and 106. Cross members 52, 54, and 56 are rigidly connected to bottom chords 78, webs 76, and doubler plates 108 abreast of posts 104 and 106 respectively to form a moment connection to each of the side sills 42, 44, and by connection, the top chords 70. The cross members 52, 54 and 56 are connected to corresponding center reinforced side posts 106 and end reinforced side posts 104, respectively. This rigid structure permits the cross members 52, 54 and 56 to carry a bending moment between side beams 42, 44.

In the configuration described above, the cross members 52, 54 and 56 work in co-operation with posts 106 and 104 respectively, to act as resilient u-shaped biasing members, or springs tending to resist lateral deflection of the top chords 70 and to resist local twisting, or rotation, of the side sills 42, 44 about an axis parallel to the longitudinal axis of the railcar 20.

Alternate Embodiments

In an alternate embodiment, additional end cross beams (not shown) may be placed between side sill assemblies 42 and 44 to accommodate domestic container sizes in addition to ISO container sizes. The additional cross beams can be each located between centre cross beam 52 and an end cross beam 54, 56. In this configuration, the unequal pitch of the cross members is such that the well structure 40 can accommodate, as above, either two ISO 20 foot containers, a single 40 foot ISO container, a single 45 foot domestic container or a single 48 foot domestic container. Depending on the configuration of the container carried in well structure 40, rail car 20 is also designed to support an upper, stacked 40 foot ISO container, or single stacked 45 foot, 48 foot or 53 foot domestic containers.

Figures 17A, 17B, 17C:
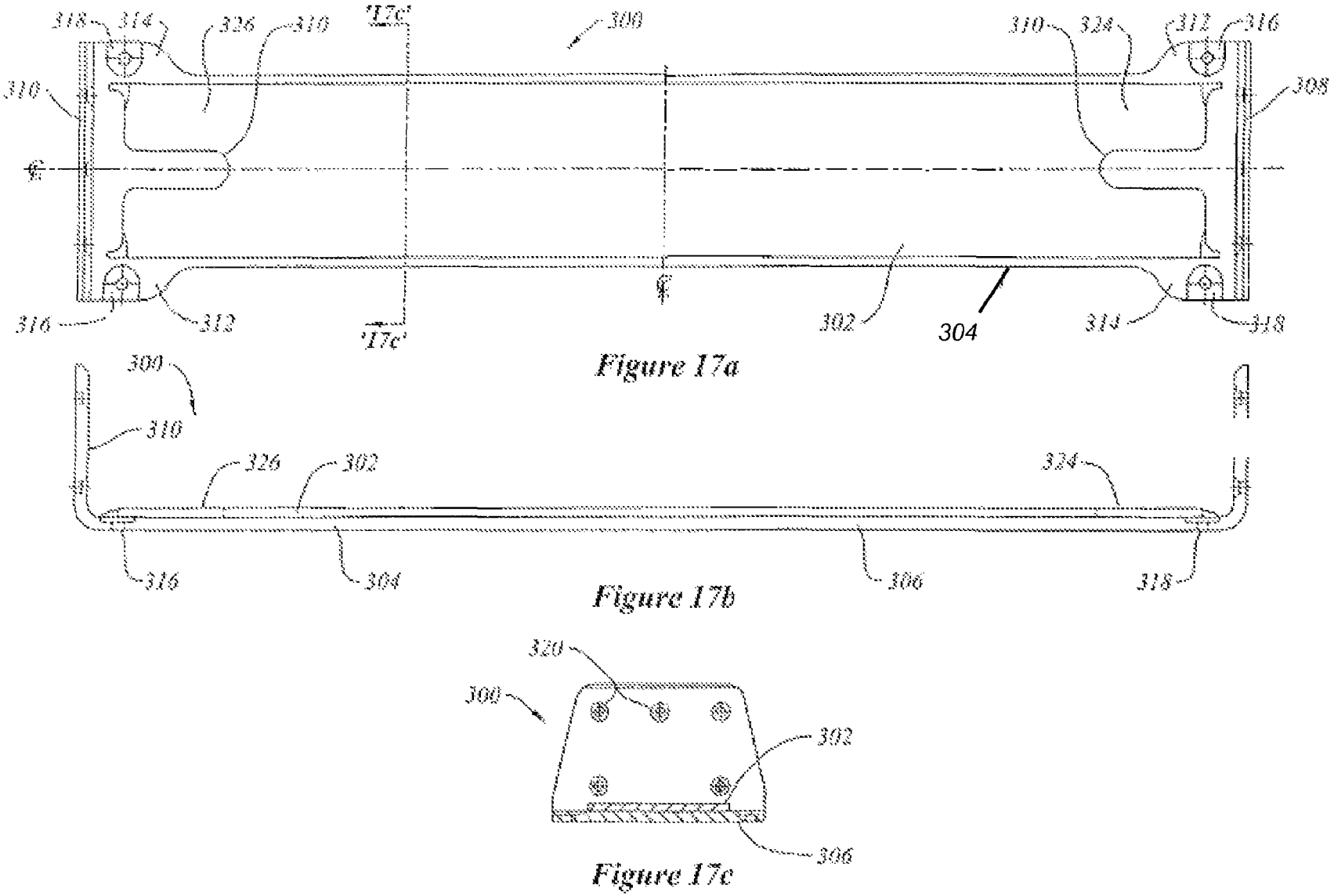
FIG. 17*a*, shows a top view of further alternative embodiment of an intermediate cross member.
FIG. 17*b*, shows a side view of the cross member of FIG. 17*a*.
FIG. 17*c*, shows an end view of the cross member of FIG. 17*a.*

FIGS. 17*a*, 17*b* and 17*c*, show an alternative embodiment in which a center cross member 300 has the form of a laminate, having a first, monolithic bridging member 304, and a reinforcing member in the nature of a plate 302 welded to the upper surface of bridging member 304. Bridging member 304 has substantially the same configuration as described above for center cross member 52, being a plate of constant thickness having a central spanning portion 306 bounded by widened, formed ends identified as attachment fittings 308 and 310, by which to make bolted connections to side sills 42, 44, in the manner described above. Each attachment fitting, 308 or 310, is a formed, bent toe having a horizontal portion that is wider than spanning portion 306, and that merges smoothly into spanning portion 306. The wide horizontal portion has ears, or lugs, 312, 314 and counter sunk bores 316, 318 by which vertically oriented bolts can attach bridging member 304 to the inwardly extending toe of the bottom chord of either side sill. The upwardly bent toes have an array of countersunk bolt holes 320, by which horizontally oriented bolts can attach bridging member 304 to side sills 42, 44 in the same manner as cross member 52, described above. The footprint of bolt holes 320 and braces 316, 318 is interchangeable with that of member 52 described above.

In this embodiment, the upturned toes are of roughly equal thickness to spanning portion 306, less a machining allowance for providing faces contacting side sills 42, or 44, as opposed to being machined down from a much greater thickness, as in cross member 52. Machining of the sides of the bent portion may be employed, as above, to reduce the tendency to provide fatigue crack initiation sites. Alternatively, if machining is required, the amount of material to be removed is significantly reduced by starting with a thinner member. Further, the forming of a thinner member is generally easier than the forming of a thicker member.

Plate 302 is welded to bridging member 304, to form a two layered laminate. More than two layers can be used if desired. The combined thickness of bridging member 304 and plate 302 is comparable to the through thickness of the spanning portion of cross member 52. For example, in one embodiment bridging member 304 may be at least 1 inch thick and the laminate 302 may be ⅝ of an inch thick or more. The ends of plate 302 provide flat surfaces 324, 326 upon which the corners of 20 ft containers can seat.

While plate 302 may be connected to either surface of longitudinal portion 306, it is preferably connected to the side of the member closest to the lading. In this configuration, plate 302 may protect bridging member 304 when lading is placed thereon. Plate 302 substantially covers the entire longitudinal portion 306, and may be thinner than the bridging member 304. Welding about the perimeter of the plate 302 may be used to connect the laminate 302 to the bridging member 304. Plate 302 may have a rebate 310 at an end, wherein the rebate 310 extends along the longitudinal centerline of the laminate 302. The periphery of rebate 310 provides a serpentine weld path, the weld being predominantly in shear.

Plate 302 can be made of a higher yielding material than might otherwise be used, and need not be of the same yield strength as bridging member 304. For example, steel of 50 ksi yield is commonly used for formed parts, such as bridging member 304, whereas a flat plate, such as plate 302, can be of a different yield, such as of 60 or 70 ksi, or higher, yield. Furthermore, lamination of plate 302 and bridging member 304 can be made to give a residual tensile stress in plate 302, and a residual compressive stress in the spanning portion of bridging member 304.

While the application of a laminate to a center cross member has been described, a laminate may also be applied to strengthen and/or protect any of the other members 52, 54, 56, 58, 60 or the cross braces 61 to 64 in a similar manner.

Although the embodiment illustrated in FIG. 1*a* and described above is preferred, the principles of the present invention are not limited to this specific example which is given by way of illustration. It is possible to make other embodiments that employ the principles of the invention and that fall within its spirit and scope as defined by the following claims and their equivalents. In particular, the cross members or other features described above, may be adapted to fit other rail car designs.

What is claimed is:

1. A first container support cross member for a rail road well car, the well car having a pair of lengthwise spaced apart first and second end structures supported by rail car trucks for rolling motion in a longitudinal direction and a pair of crosswise spaced apart first and second side beams extending lengthwise between the end structures, the well car having a well defined between the side beams, the well car having structure for supporting a shipping container in the well, that structure for supporting a shipping container in the well including at least said first container support cross member and a second container support cross member distantly spaced in said longitudinal direction from said first container support cross member, the rail road well car having a crosswise extending cross-tie located intermediate the first and second container support cross members; when mounted in the well, the first container support cross member having a first end mounted to the first side beam of the rail road well car, and a second end mounted to the second side beam, said first container support cross member then being in a position to support one end of a shipping container carried within the well, wherein said first container support cross member comprises:

a first member and a second member;

the first member being a monolithic beam member having a first end portion, a second end portion, and a medial portion between said first and second end portions;

said first monolithic beam member not including end castings, and extending from an upstanding portion of the first side beam to an upstanding portion of the second side beam;

said first end portion of said monolithic beam member being connected by mechanical fasteners to said first side beam at a first moment connection;

said second end portion of said monolithic beam member being connected by mechanical fasteners to said second side beam at a second moment connection;

said first container support cross member being operable when thus installed to resist sideways deflection of a top chord of each of the first and second side beams;

said second member overlying said first end portion of said first member and defining a first seat upon which to seat a corner of an end of a shipping container;

said second end portion of said first member having a second seat arranged thereon for seating another corner of a shipping container; and said first container support cross member not being a cross-tie.

2. The first container support cross member of claim 1, wherein said second member also overlies the second end portion of said first member and defines the second seat.

3. The first container support cross member of claim 1 further comprising, a first toe and a second toe;

the first toe being formed in said first end portion of the first member, said first toe having a first upwardly extending flange; said first upwardly extending flange having bores defined therein to permit the first toe to be attached by a mechanical fastener to the first side beam;

the second toe being formed in said second end portion of the first member, said second toe having a second upwardly extending flange; said second upwardly extending flange having bores defined therein to permit said second toe to be attached by mechanical fasteners to the second side beam;

said first toe having an horizontal portion adjoining said medial portion of said first member, said first flange extending upwardly from said horizontal portion; and said bores in said first flange include at least a first bore offset upwardly from said horizontal portion by a first distance, and at least a second bore offset upwardly from said horizontal portion by a second distance, said second distance being greater than said first distance.

4. The first container support cross member of claim 1 wherein:

said first container support cross member has a first toe and a second toe;

said first toe is formed in said first end portion of the first member, said first toe has a first upwardly extending flange;

said first upwardly extending flange has bores defined therein to permit said first toe to be attached by mechanical fasteners to the first side beam;

the second toe is formed in said second end portion of the first member, said second toe has a second upwardly extending flange;

said second upwardly extending flange has bores defined therein to permit said second toe to be attached by mechanical fasteners to the second side beam; and said first flange has a root and a tip, said first flange having a width in the longitudinal direction, said width being narrower at said tip than at said root.

5. The first container support cross member of claim 1 wherein:

said first container support cross member has a first toe and a second toe;

said first toe is formed at said first end portion of said first member, said first toe has a first upwardly extending flange;

said first upwardly extending flange has bores defined therein to permit the first toe to be attached by mechanical fasteners to the first side beam;

said second toe is formed at the second end portion of said first member, said second toe has a second upwardly extending flange;

said second upwardly extending flange has bores defined therein to permit said second toe to be attached by a mechanical fastener to the second side beam; and said first flange has a root and a tip; and said first flange has a through thickness, said through thickness being greater at said root than at said tip.

6. The first container support cross member of claim 1 wherein:

the first container support cross member has a first toe and a second toe;

the first toe is formed in said first end portion of the first member, said first toe has a first upwardly extending flange;

said first upwardly extending flange has bores defined therein to permit said first toe to be attached by a mechanical fastener to the first side beam;

said second toe is formed in said second end portion of the first member, said second toe has a second upwardly extending flange;

said second upwardly extending flange has bores defined therein to permit said second toe to be attached by mechanical fasteners to the second side beam; and said bores in said first flange run predominantly horizontally; and said first toe has at least one lug formed thereat, said lug having a bore formed therein; and said bore of said lug extends predominantly vertically.

7. The first container support cross member of claim 1 wherein:

said first container support cross member has a first toe and a second toe;

the first toe is formed at the first end portion of the first member;

said second toe is formed at the second end portion of the first member;

said first toe has a first upwardly extending flange;

said second toe has a second upwardly extending flange;

said first upwardly extending flange has bores defined therein to permit the first toe to be attached by mechanical fasteners to the first side beam;

said monolithic beam member is formed from an initially flat bar, each of said flanges of said toes being formed by bending an end of said flat bar such that said monolithic beam member has a U-shape.

8. The first container support cross member of claim 1 wherein:

said first member of said first container support cross member has a first toe and a second toe;

said first toe is formed in said first end portion of the first member;

said first toe has a first upwardly extending flange;

said first toe has a horizontal portion between said medial portion of said first member and said flange of said first toe; and said horizontal portion of said first member is wider in said longitudinal direction adjacent to said flange than it is adjacent to said medial portion.

9. The first container support cross member of claim 1 wherein said second member is welded to said first end portion of the first member and, when a shipping container is received within the rail road well car, said second member lies between said first member and the shipping container.

10. The first container support cross member of claim 9 wherein said second member extends continuously from the first end portion of said first member, across said medial portion, to said second end portion of said first member to form a laminate.

11. The first container support cross member of claim 1 wherein a container support cone is mounted to each seat of said cross member.

12. The first container support cross member of claim 1 wherein at least one diagonal strut root fitting is mounted to said cross member.

13. A rail road well car for carrying intermodal containers, comprising:

a pair of lengthwise spaced apart first and second end structures supported by rail car trucks for rolling motion in a longitudinal direction;

a pair of cross-wise spaced apart first and second side beams extending lengthwise between said end structures, said first and second side beams defining a well therebetween in which to carry intermodal shipping containers;

a first cross member mounted between said first and second side beams in a position to support one end of a shipping container carried in said well;

a second cross member mounted between said first and second side beams in a position to support another end of the shipping container;

a first cross-tie mounted between said first and second side beams at a location intermediate said first and second cross members;

said first cross member being mounted apart from said second cross member a distance that is nominally one of (a) 20 ft therefrom, such that a 20 ft international shipping container can be supported with its ends on said first and second cross members respectively; and (b) 40 ft therefrom, such that a 40 ft international shipping container can be supported with its ends on said first and second cross members respectively;

said first cross-tie not being a container support cross member;

said first and second cross members being first and second container support cross members, and not being cross-ties;

said first cross member having a first end mounted to said first side beam, and a second end mounted to said second side beam;

said first cross member having a first member and a second member;

said first member being formed from a monolithic bar;

said monolithic bar not including welded-on end castings, and extending from an upstanding portion of the first side beam to an upstanding portion of the second side beam;

the first member having a first end portion, a second end portion, and a medial portion between said first and second end portions;

said first member having a first bent toe formed in said first end portion thereof;

said first member having a second bent toe formed in said second end portion thereof;

said first bent toe having a mechanical fastener moment connection to said first side beam;

said second bent toe having a mechanical fastener moment connection to said second side beam;

said second member overlying said first end portion of said first member and defining a first seat upon which, in use, to locate a corner of an intermodal shipping container; and, said second end of said first cross member having a second seat arranged thereon for seating another corner of that same intermodal shipping container.

14. The rail road well car of claim 13 further comprising, said first toe having a first upwardly extending flange; said first upwardly extending flange having bores defined therein to permit the first toe to be attached by mechanical fasteners to the first side beam;

said second toe having a second upwardly extending flange; said second upwardly extending flange having bores defined therein to permit said second toe to be attached by mechanical fasteners to the second side beam;

said first toe having a horizontal portion adjoining said medial portion of said first member, said first flange extending upwardly from said horizontal portion; and said bores in said first flange at least a first bore offset upwardly from said horizontal portion by a first distance, and at least a second bore offset upwardly from said horizontal portion by a second distance, said second distance being greater than said first distance.

15. The rail road well car of claim 13 wherein:

said first toe is formed at said first end portion of the first member, said first toe has a first upwardly extending flange;

said first upwardly extending flange has bores defined therein to permit said first toe to be attached by mechanical fasteners to said first side beam;

said second toe is formed at the second end portion of said first member, said second toe has a second upwardly extending flange;

said second upwardly extending flange has bores defined therein to permit said second toe to be attached by mechanical fasteners to said second side beam; and any one of, (a) said first flange has a root and a tip, said first flange having a width in the longitudinal direction, said width being narrower at said tip than at said root;

(b) said first flange has a root and a tip, and said first flange has a through thickness, and said through thickness is greater at said root than at said tip;

(c) said first flange has a root and a tip, said bores in said first flange run predominantly horizontally; and said first toe has at least one lug formed thereat, said lug having a bore formed therein; and said bore of said lug extends predominantly vertically; and (d) said monolithic bar is formed from an initially flat bar, each of said flanges of said toes being formed by bending an end of said flat bar such that said monolithic bar has a U-shape.

16. The rail road well car of claim 13 wherein:

said first toe has a first upwardly extending flange;

said first toe has a horizontal portion between said medial portion of said first member and said flange of said first toe; and said horizontal portion of said first member is wider adjacent to said flange than it is adjacent to said medial portion.

17. The rail road well car of claim 13 wherein said second member is welded to said first end portion of the first member and, when a shipping container is received within the rail road well car, said second member lies between said first member and the shipping container.

18. The rail road well car of claim 17 wherein said second member extends continuously from the first end portion of said first member, across said medial portion, to said second end portion of said first member to form a laminate.

19. The rail road well car of claim 13 wherein a container support cone is mounted to each seat of said cross members.

20. The rail road well car of claim 13 wherein at least one diagonal strut root fitting is mounted to said cross members.

* * * * *